US010139767B2

(12) United States Patent
Kobayashi et al.

(10) Patent No.: US 10,139,767 B2
(45) Date of Patent: Nov. 27, 2018

(54) IMAGE FORMING APPARATUS CONTROLLING RECORDING SHEET CONVEYANCE SPEED

(71) Applicant: KONICA MINOLTA, INC., Chiyoda-ku, Tokyo (JP)

(72) Inventors: Yuji Kobayashi, Toyohashi (JP); Harumitsu Fujimori, Machida (JP); Hiroshi Hiraguchi, Toyokawa (JP); Satoshi Chikazawa, Toyokawa (JP); Takaki Kato, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/176,462

(22) Filed: Jun. 8, 2016

(65) Prior Publication Data

US 2016/0370740 A1 Dec. 22, 2016

(30) Foreign Application Priority Data

Jun. 17, 2015 (JP) ..... 2015-121881

(51) Int. Cl.
*G03G 15/00* (2006.01)

(52) U.S. Cl.
CPC ..... *G03G 15/652* (2013.01); *G03G 15/505* (2013.01); *G03G 2215/00455* (2013.01);
(Continued)

(58) Field of Classification Search
CPC ..... G03G 15/2028; G03G 15/2085; G03G 15/505; G03G 15/6529; B41J 15/00; B41J 15/005
(Continued)

(56) References Cited

U.S. PATENT DOCUMENTS 4,943,863 A * 7/1990 Ainoya ..... G03G 15/164 399/297
5,745,832 A * 4/1998 Yoshiuchi ..... G03G 15/2064 399/384
(Continued)

FOREIGN PATENT DOCUMENTS

CN 101013281 A 8/2007
JP 2005-041623 A 2/2005
(Continued)

OTHER PUBLICATIONS

Office Action (Notice of Reasons for Rejection) dated May 30, 2017, by the Japanese Patent Office in corresponding Japanese Patent Application No. 2015-121881, and an English Translation of the Office Action (28 pages).
(Continued)

*Primary Examiner* — Walter L Lindsay, Jr.
*Assistant Examiner* — Arlene Heredia Ocasio
(74) *Attorney, Agent, or Firm* — Buchahan Ingersoll & Rooney PC

(57) ABSTRACT

An image forming apparatus that transfers an image from an image carrier onto a sheet passing between the image carrier rotating and a transfer member includes a fixing unit configured to thermally fix the image on the sheet while nipping and conveying the sheet with a pair of fixing members after the transfer, at least one of the fixing members rotating; a measuring unit configured to measure surface movement speed of the sheet in a non-contact manner while the sheet is being conveyed by the fixing members; and a control unit configured to control rotation speed of the fixing members in accordance with a result of the measurement, to adjust speed of conveyance of the sheet to a target speed determined beforehand for peripheral speed of the image carrier, the
(Continued)

control being performed while the sheet being conveyed is in contact with the transfer member and the fixing members.

18 Claims, 8 Drawing Sheets

(52) U.S. Cl.
CPC ..... *G03G 2215/0135* (2013.01); *G03G 2215/2045* (2013.01)

(58) Field of Classification Search
USPC ..... 399/68
See application file for complete search history.

(56) References Cited

U.S. PATENT DOCUMENTS 6,220,686 B1 * 4/2001 Ludi ..... B41J 11/008 347/4
6,409,294 B1 * 6/2002 Zimmermann ..... B41J 11/0095 347/2
2003/0133097 A1 * 7/2003 Yamaguchi ..... B65H 7/14 356/28
2008/0101813 A1 * 5/2008 Maul ..... G03G 15/6529 399/68
2009/0060548 A1 * 3/2009 Souda ..... G03G 15/6573 399/68
2010/0134552 A1 6/2010 Suzuki et al.
2010/0239295 A1 * 9/2010 Mikutsu ..... G03G 15/2028 399/68

FOREIGN PATENT DOCUMENTS

JP 2006-267484 A 10/2006
JP 2007-058079 A 3/2007
JP 2007-139882 A 6/2007
JP 2009-251237 A 10/2009
JP 2010-155723 A 7/2010
JP 2012-096852 A 5/2012
JP 2013-071323 A 4/2013
JP 2015-038457 A 2/2015

OTHER PUBLICATIONS

Office Action (First Office Action) dated Apr. 3, 2018, by the State Intellectual Property Office of the People's Republic of China in corresponding Chinese Patent Application No. 201610412884.0, and an English Translation of the Office Action. (16 pages).

* cited by examiner

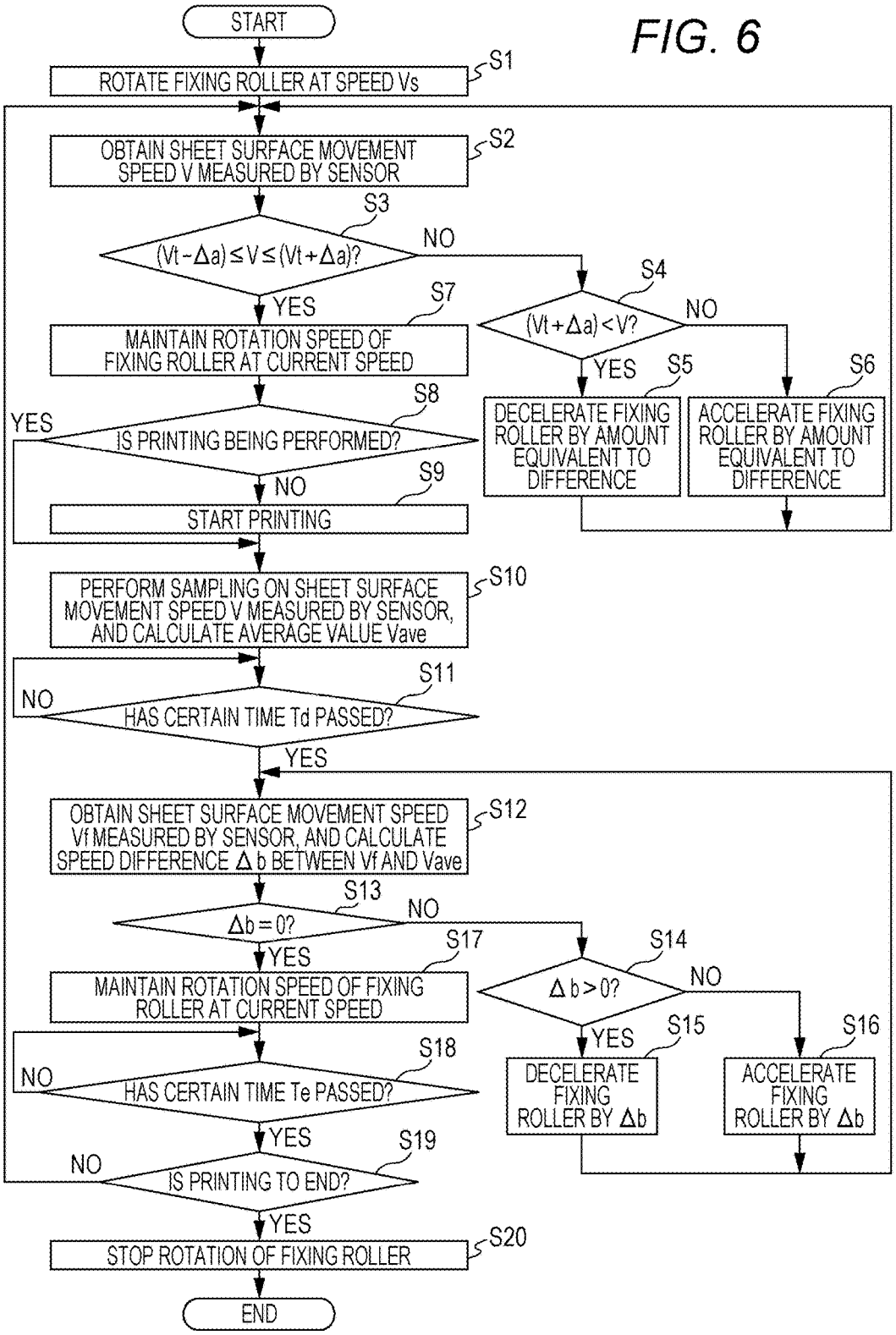
FIG. 6
START
ROTATE FIXING ROLLER AT SPEED Vs
S1
OBTAIN SHEET SURFACE MOVEMENT SPEED V MEASURED BY SENSOR
S2
S3
(Vt−Δa)≤V≤(Vt+Δa)?
NO
YES
S4
(Vt+Δa)<V?
NO
YES
S5
S6
S7
MAINTAIN ROTATION SPEED OF FIXING ROLLER AT CURRENT SPEED
DECELERATE FIXING ROLLER BY AMOUNT EQUIVALENT TO DIFFERENCE
ACCELERATE FIXING ROLLER BY AMOUNT EQUIVALENT TO DIFFERENCE
S8
YES
IS PRINTING BEING PERFORMED?
NO
S9
START PRINTING
PERFORM SAMPLING ON SHEET SURFACE MOVEMENT SPEED V MEASURED BY SENSOR, AND CALCULATE AVERAGE VALUE Vave
S10
S11
NO
HAS CERTAIN TIME Td PASSED?
YES
OBTAIN SHEET SURFACE MOVEMENT SPEED Vf MEASURED BY SENSOR, AND CALCULATE SPEED DIFFERENCE Δb BETWEEN Vf AND Vave
S12
S13
Δb=0?
NO
YES
S17
MAINTAIN ROTATION SPEED OF FIXING ROLLER AT CURRENT SPEED
S14
Δb>0?
NO
YES
S15
S16
DECELERATE FIXING ROLLER BY Δb
ACCELERATE FIXING ROLLER BY Δb
S18
NO
HAS CERTAIN TIME Te PASSED?
YES
S19
NO
IS PRINTING TO END?
YES
S20
STOP ROTATION OF FIXING ROLLER
END

IMAGE FORMING APPARATUS CONTROLLING RECORDING SHEET CONVEYANCE SPEED

The entire disclosure of Japanese Patent Application No. 2015-121881 filed on Jun. 17, 2015 including description, claims, drawings, and abstract are incorporated herein by reference in its entirety.

BACKGROUND OF THE INVENTION

Field of the Invention

The present invention relates to an image forming apparatus that thermally fixes an image formed on a sheet.

Description of the Related Art

An electrophotographic image forming apparatus, such as a printer, executes a print job to print a toner image on a sheet being conveyed. The printing is performed as follows.

A toner image is formed on an image carrier such as a rotating photosensitive member or the like, and the toner image on the image carrier is transferred onto a sheet passing between the image carrier and a transfer member facing the image carrier at the transfer position of the image carrier. After the transfer, the sheet is nipped and conveyed by a pair of fixing members positioned to face each other at the fixing position of a fixing unit. The fixing members may be a fixing roller on the driving side and a pressure roller on the driven side. The toner image on the sheet is fixed on the sheet with heat and pressure.

In a conventional image forming apparatus, the distance from the transfer position to the fixing position on the downstream side in the sheet conveying direction is normally shorter than the length of a sheet of the maximum size in the sheet conveying direction, since there has been a demand for a reduction in device size. Because of this, while a sheet is being conveyed, the sheet is in contact with the transfer member and the fixing members at some point of time. In an apparatus that can convey not only sheets of standard sizes such as A4 but also a long continuous paper sheet, for example, the sheet being conveyed stays in contact with the transfer member and the fixing members for a long time.

If the portion of the sheet located between the transfer member and the fixing members is loosened while the sheet being conveyed is in contact with the transfer member and the fixing members, winkles easily appear on the sheet due to the heat and the pressure applied at the time when the sheet passes between the fixing members.

To prevent such wrinkles, the fixing roller is rotated at such a target speed that the sheet conveyance speed becomes slightly higher than the peripheral speed (the system speed) of the image carrier. In this manner, small tension is applied to the portion of the sheet, without any wrinkles appearing on the portion of the sheet.

However, even if the fixing roller continues to rotate at a constant target speed after the start of printing, the diameter of the fixing roller might become larger due to thermal expansion of the fixing roller. In such a case, the conveyance speed of the sheet being conveyed by the fixing roller becomes higher, leading to degradation of the quality of the reproduced image due to transfer shift caused by the difference from the peripheral speed of the image carrier.

To prevent this, the relationship between elapsed time and variation in speed caused by thermal expansion of the fixing roller after the start of printing may be determined beforehand through experiments, for example, and the rotation speed of the fixing roller may be adjusted during printing in accordance with the time elapsed since the start of the printing.

However, even if the rotation speed of the fixing roller is adjusted in accordance with experimental data obtained in advance, a difference from the actual diameter of the fixing roller that has thermally expanded, and a difference from the actual diameter that has changed over time are not taken into account. Therefore, image quality degradation due to transfer shift can be reduced only to a certain extent.

Particularly, in a color printer that transfers and superimposes toner images in different colors onto a sheet, color shift occurs due to transfer shift, resulting in degradation of the color reproduced image.

The above described problems occur not only in structures that apply tension to the sheet portion in contact with the transfer member and the fixing members. For example, in some apparatuses, transfer shift occurs more easily than wrinkles on the sheet when tension is applied to the sheet portion.

In such an apparatus, tension is applied to the sheet portion, to loosen the sheet portion (or to form a loop). This loop is formed by making the rotation speed of the fixing roller slightly lower than the system speed. However, if the rotation speed of the fixing roller is maintained at the lowered level, the size of the loop (or the loop amount) continues to increase. To counter this, loop amount control is performed by alternating between an operation to make the rotation speed of the fixing roller lower than the system speed and an operation to make the rotation speed of the fixing roller higher than the system speed at regular intervals. In this manner, the amount of the formed loop can be prevented from becoming too large.

In such a structure, if the rotation speed of the fixing roller becomes too high due to thermal expansion of the fixing roller, any loop is not formed, and tension is generated. As a result, transfer shift might occur.

SUMMARY OF THE INVENTION

The present invention has been made in view of those problems, and an object thereof is to provide an image forming apparatus that can stabilize the conveyance speed of a sheet being conveyed by fixing members while the sheet being conveyed is in contact with a transfer member and the fixing members.

To achieve the abovementioned object, according to an aspect, an image forming apparatus that transfers an image from an image carrier onto a sheet passing between the image carrier rotating and a transfer member reflecting one aspect of the present invention comprises: a fixing unit configured to thermally fix the image on the sheet while nipping and conveying the sheet with a pair of fixing members after the transfer, at least one of the fixing members rotating; a measuring unit configured to measure surface movement speed of the sheet in a non-contact manner while the sheet is being conveyed by the fixing members; and a control unit configured to control rotation speed of the fixing members in accordance with a result of the measurement carried out by the measuring unit, to adjust speed of conveyance of the sheet to a target speed determined beforehand for peripheral speed of the image carrier, the control being performed while the sheet being conveyed is in contact with at least the transfer member and the fixing members.

Further, the target speed is preferably higher than the peripheral speed of the image carrier by a certain value.

Here, the transfer member is preferably a transfer roller in contact with a peripheral surface of the image carrier.

Furthermore, the measuring unit preferably includes: a light source configured to emit a light beam toward one of a front surface and a back surface of the sheet being conveyed; and a light receiving unit configured to receive light reflected from the one surface, the reflected light being of the light beam emitted onto the one surface of the sheet, and the measuring unit preferably measures the surface movement speed of the sheet in accordance with a rate of change in the amount of the reflected and received light.

Here, the light source is preferably one of a laser light source and an LED light source, and the measuring unit preferably receives one of a speckle pattern and a shade pattern with the light receiving unit, and measures the surface movement speed of the sheet in accordance with a rate of change in the amount of the reflected and received light caused by a rate of change in the received pattern, the one of the speckle pattern and the shade pattern being formed by minute irregularities on the one surface of the sheet being conveyed when the light beam is emitted from the one of the laser light source and the LED light source onto the one surface.

Here, an angle between the light beam entering the one surface of the sheet and the one surface of the sheet is preferably between 20 degrees and 45 degrees, and the light receiving unit is preferably located in a position where light reflected at 90 degrees with respect to the one surface of the sheet can be received.

Furthermore, the measuring unit preferably emits the light beam onto the one surface of the sheet passing through a predetermined measurement position, the predetermined measurement position being located on a downstream side of the transfer member in a sheet conveying direction and on an upstream side of the fixing members in the sheet conveying direction in a sheet conveyance path.

Here, the predetermined measurement position is preferably a position where the light beam reflected by the one surface of the sheet is not blocked by the fixing members, and is the position closest possible to the fixing members in the sheet conveying direction.

Further, the image is preferably formed on only one of the front surface and the back surface of the sheet, and the measuring unit preferably emits the light beam onto the other one of the front surface and the back surface of the sheet being conveyed, any image not being to be formed on the other surface of the sheet.

Furthermore, the measuring unit preferably emits a first light beam from an upstream side in a sheet conveying direction onto one of a front surface and a back surface of the sheet being conveyed while emitting a second light beam from a downstream side in the sheet conveying direction, receives the first and second light beams reflected by the one surface of the sheet, and measures the surface movement speed of the sheet in accordance with a difference in wavelength caused by a Doppler effect between the reflected and received light beams.

Furthermore, the control unit preferably determines whether there exists a difference from the target speed every time obtaining the surface movement speed of the sheet measured by the measuring unit, and, when there exists a difference in speed, controls the rotation speed of the fixing members to cancel out the difference.

Further, when an image forming operation is started, the control unit preferably acquires the surface movement speed of the sheet measured by the measuring unit, and, during a predetermined time after the start of the image forming operation, maintains the rotation speed of the fixing members at the speed measured at the start of the image forming operation, and, when the predetermined time has passed, the control unit preferably determines whether there exists a difference between the surface movement speed of the sheet measured by the measuring unit at the time when the predetermined time has passed and the surface movement speed of the sheet measured at the start of the image forming operation, and, when there exists a difference in speed, updates the rotation speed of the fixing members to cancel out the difference.

Further, the image forming apparatus preferably comprises a second measuring unit configured to measure peripheral surface movement speed of the image carrier in a non-contact manner, and where Vp represents a target speed of the peripheral surface movement speed of the image carrier, Vq represents the peripheral surface movement speed measured by the second measuring unit, Vr represents a value obtained by subtracting Vp from Vq, and a target speed Vt of the surface movement speed of the sheet at the time when the peripheral surface movement speed of the image carrier is equal to the target speed Vp is a reference value, the control unit preferably controls rotation speed of the image carrier in accordance with a result of the measurement carried out by the second measuring unit, to adjust the peripheral surface movement speed of the image carrier to the target speed Vp, and, every time obtaining the peripheral surface movement speed Vq measured by the second measuring unit, the control unit preferably calculates Vr by subtracting Vp from Vq, and controls the rotation speed of the fixing members by updating the target speed of the surface movement speed of the sheet with a value obtained by adding Vr to the reference value Vt.

Further, the image forming apparatus preferably implements an intermediate transfer method, wherein, after toner images in different colors are formed on a plurality of photosensitive members, and the toner images on the photosensitive members are transferred and superimposed onto an intermediate transfer member, the toner images in the respective colors transferred and superimposed onto the intermediate transfer member are transferred onto one of a long continuous paper sheet and a cut paper sheet passing between the intermediate transfer member and a transfer roller positioned to face the intermediate transfer member, the image carrier is preferably the intermediate transfer member, the transfer member is preferably the transfer roller, and the sheet is preferably the one of the continuous paper sheet and the cut paper sheet.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 6 is a flowchart showing the details of sheet conveyance control to be performed by the motor control unit;

DESCRIPTION OF THE PREFERRED EMBODIMENTS

Hereinafter, an embodiment of the present invention will be described with reference to the drawings. However, the scope of the invention is not limited to the illustrated examples.

In the description below, tandem color printers (hereinafter referred to simply as "printers") will be described as image forming apparatuses according to embodiments of the present invention.

First Embodiment (1) Overall Structure of a Printer

Figure 1:
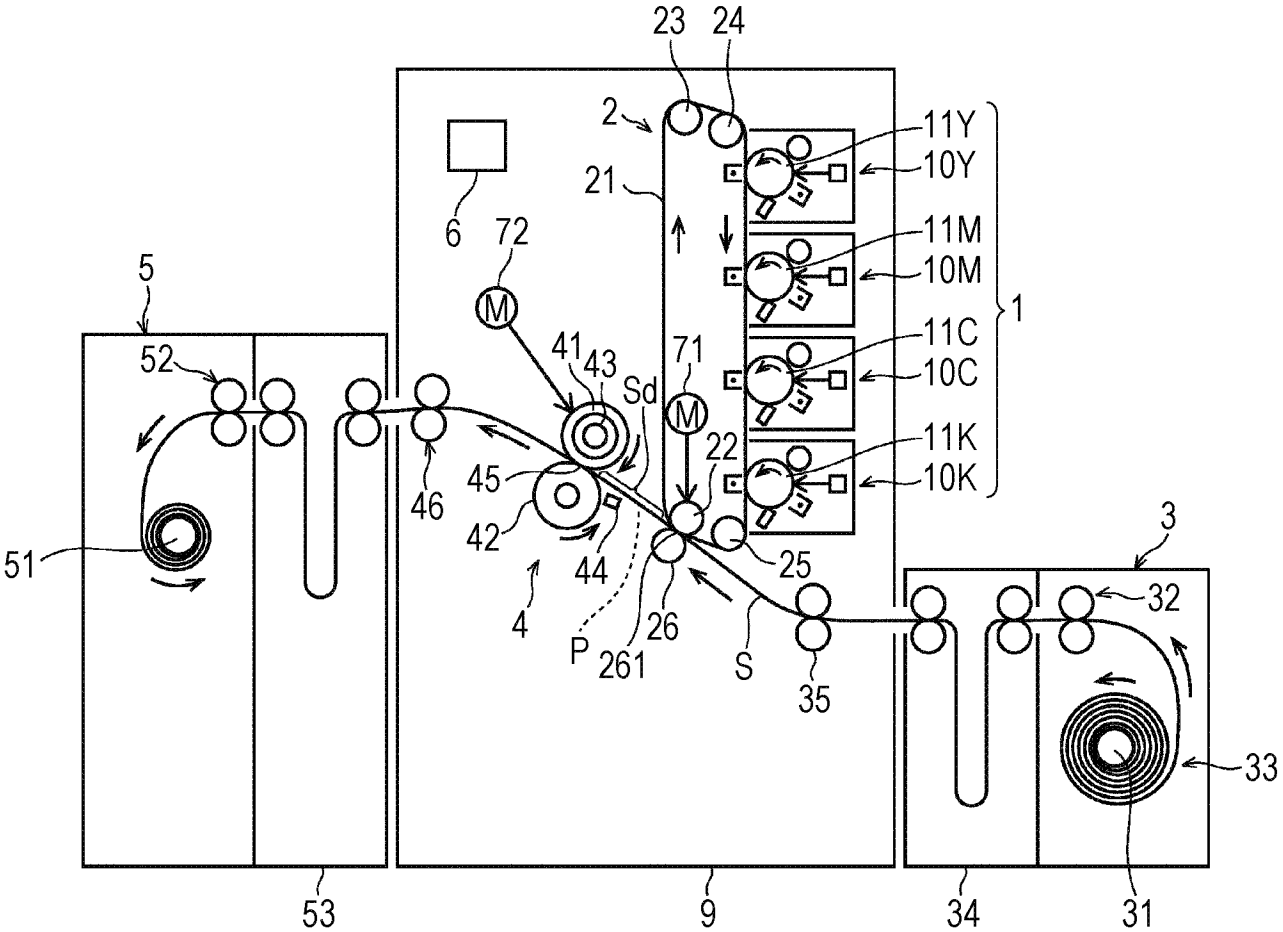
FIG. 1 is a diagram showing the overall structure of a printer according to a first embodiment.

FIG. 1 is a diagram showing the overall structure of a printer.

As shown in FIG. 1, the printer is designed to form an image according to a known electrophotographic method. The printer includes an image forming unit 1, an intermediate transfer unit 2, a sheet feeder unit 3, a fixing unit 4, a sheet winder unit 5, and a general control unit 6. The printer is connected to a network (a LAN, for example). When accepting a print job execution instruction from an external terminal device (not shown), the printer forms a color image in yellow (Y), magenta (M), cyan (C), and black (K), in accordance with the instruction.

The image forming unit 1 includes imaging units 10Y through 10K corresponding to the respective colors Y through K. The imaging unit 10Y electrically charges the surface of a photosensitive drum 11Y rotating at constant speed. After an electrostatic latent image is formed on the charged photosensitive drum 11Y through exposure scanning performed by an exposure unit, the imaging unit 10Y develops the electrostatic latent image with a Y-color toner, and electrostatically performs primary transfer of the developed Y-color toner image onto an intermediate transfer belt 21.

Like the imaging unit 10Y, the other imaging units 10M, 10C, and 10K carry out the respective processes of charging, exposure, development, and primary transfer. Through the primary transfer, an M-color toner image formed on a photosensitive drum 11M, a C-color toner image formed on a photosensitive drum 11C, and a K-color toner image formed on a photosensitive drum 11K are transferred onto the intermediate transfer belt 21. The timings to form the toner images in the colors Y through K of an image of a one-page original document are determined beforehand, so that the toner images in the colors Y through K can be superimposed on one another when transferred onto the intermediate transfer belt 21. In a case where the original document contains more than one page, the toner images corresponding to the images of the respective pages of the original document are sequentially formed on the intermediate transfer belt 21 at regular intervals in the belt rotating direction.

The intermediate transfer unit 2 includes the intermediate transfer belt 21, a driving roller 22 and driven rollers 23, 24, and 25 around which the intermediate transfer belt 21 is stretched, and a secondary transfer roller 26.

The driving roller 22 rotates with the rotary driving force of a belt motor 71, and causes the intermediate transfer belt 21 to rotate in the direction indicated by arrows in the drawing. The belt motor 71 is formed with a DC brushless motor. The driven rollers 23, 24, and 25 rotate, following the rotary motion of the intermediate transfer belt 21.

While the intermediate transfer belt 21 is rotating, the toner images in the colors Y through K formed by the imaging units 10Y through 10K are superimposed on one another when transferred onto the peripheral surface 21*a* of the intermediate transfer belt 21.

By virtue of the rotary motion of the intermediate transfer belt 21, the toner images in the colors Y through K transferred onto and superimposed on the intermediate transfer belt 21 are conveyed toward the secondary transfer roller 26 located on the opposite side of the intermediate transfer belt 21 from the driving roller 22.

The secondary transfer roller 26 is in contact with the peripheral surface 21*a* of the intermediate transfer belt 21 at a secondary transfer position 261 of the intermediate transfer belt 21, and rotates following the rotary motion of the intermediate transfer belt 21.

The sheet feeder unit 3 reels a long sheet S out of rolled paper 33 wound around a rotary shaft 31, and sends the long sheet S to a sheet feed adjusting unit 34 via feeding rollers 32. The sheet feed adjusting unit 34 conveys the sheet S from the feeding rollers 32 toward conveyance rollers 35 of the printer main unit 9. The long sheet S is loosened to absorb a difference between the speed of conveyance of the sheet S reeled out of the rolled paper 33 in the sheet feeder unit 3 and the speed of conveyance of the sheet S in the printer main unit 9. In this manner, the feeding of the sheet S into the printer main unit 9 is appropriately adjusted. The sheet S is plain paper in this example, but may be paper for labeling, for example.

The sheet S supplied to the conveyance rollers 35 is wound around a winding roller 51 via the secondary transfer position 261, the fixing unit 9, discharging rollers 96, a discharge adjusting unit 53 of the sheet winder unit 5, and conveyance rollers 52. The discharge adjusting unit 53 loosens the long sheet S to absorb a difference between the speed of conveyance of the sheet S in the printer main unit 9 and the speed of conveyance of the sheet S being wound around the winding roller 51 of the sheet winder unit 5. In this manner, the discharging of the sheet S out of the printer main unit 9 is appropriately adjusted.

While the sheet S is being wound up, secondary transfer of the toner images in the colors Y through K transferred onto and superimposed on the intermediate transfer belt 21 is collectively and electrostatically performed by the secondary transfer roller 26, so that the toner images are transferred onto the front surface (or the surface in contact with the intermediate transfer belt 21) of the sheet S passing through the secondary transfer position 261. In a case where toner images of two or more pages are formed on the intermediate transfer belt 21 at regular intervals in the rotating direction of the belt, the secondary transfer of the toner images onto the sheet S is sequentially performed page by page, while the long sheet S passes through the secondary transfer position 261. The toner images of the respective pages transferred onto the sheet S through the secondary transfer are conveyed, together with the sheet S to be wound up, to the fixing unit 4.

The fixing unit 4 includes a cylindrical fixing roller 41, a pressure roller 42 pressed against the fixing roller 41 with a predetermined pressure at the fixing position 45 of the fixing roller 41, a heater 43 inserted into the fixing roller 41, and a sheet surface speed sensor 49. With the heat generated from the heater 43, the fixing roller 91 is maintained at 150° C., for example, which is the temperature necessary for fixing.

The fixing roller 41 is rotated in the direction indicated by an arrow in the drawing by a fixing motor 72 formed with a DC brushless motor. The pressure roller 42 rotates following the fixing roller 41. While nipping and conveying the sheet S, the fixing roller 41 and the pressure roller 42 thermally fix the toner images onto the front surface of the sheet S by applying heat and pressure thereto when the toner images transferred onto the sheet S through the secondary transfer pass through the fixing position 95.

The sheet S to be wound up is conveyed while in contact with both the secondary transfer roller 26 and the fixing roller 41. If the sheet portion Sd of the sheet S located between the fixing roller 41 and the secondary transfer roller 26 is loosened during the conveyance, wrinkles might appear on the sheet S at the fixing position 45 as described above.

To prevent wrinkles on the sheet S, tension in the sheet conveying direction is applied to the sheet portion Sd. To apply this tension, the target speed Vt of conveyance of the sheet S being conveyed by the fixing roller 41 (the sheet conveyance speed at the fixing position 45) on the driving side between the fixing roller 41 and the pressure roller 42 is made higher by a certain value than the movement speed (the belt peripheral speed) Vb of the peripheral surface 21*a* of the intermediate transfer belt 21 on the driving side between the intermediate transfer belt 21 and the secondary transfer roller 26.

The speed difference ΔV can be determined in the manner described below.

Figure 2:
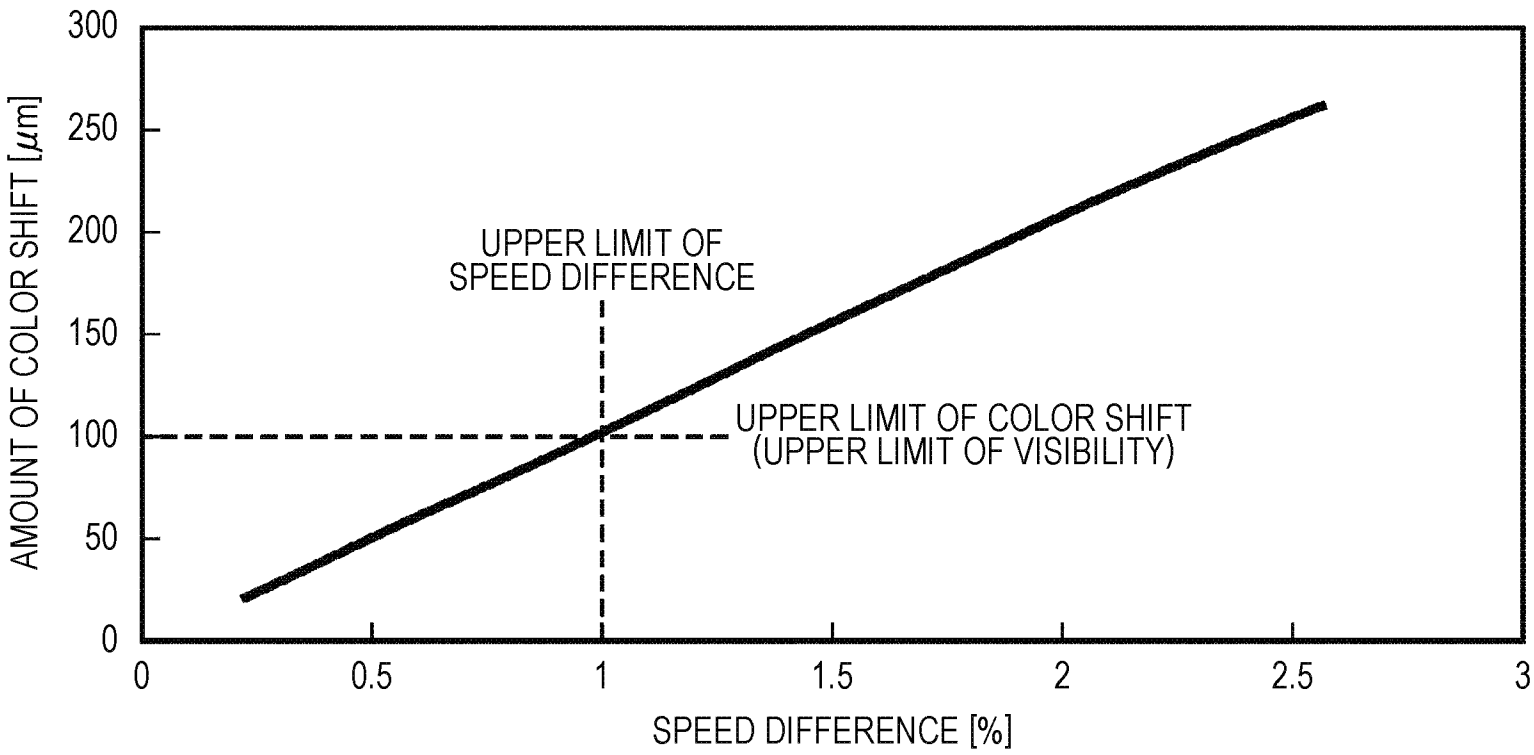
FIG. 2 is a graph showing an example of the relationship between a difference between the speed of conveyance of a sheet being conveyed by the fixing roller and the peripheral speed of the intermediate transfer belt, and an amount of color shift caused by transfer shift.

FIG. 2 is a graph showing an example relationship between a speed difference and an amount of color shift caused by transfer shift. As can be seen from the graph, the amount of color shift becomes larger as the speed difference becomes larger.

Here, the speed difference (%) is the value expressing (Vt−Vb)/Vb in percentage.

The amount of color shift (μm) indicates the amount of change that occurs when a toner image transferred from the intermediate transfer belt 21 onto the sheet S at the secondary transfer position 261 through secondary transfer shifts and expands on the sheet S in the sheet conveying direction by the amount equivalent to the speed difference, with respect to the toner image on the sheet S after secondary transfer with no speed difference (the reference case).

When the speed difference becomes larger, the amount of color shift becomes larger, and therefore, it appears to the human eye as if the quality of the reproduced image degraded. However, the tension applied to the sheet S becomes larger, and wrinkles do not easily appear on the sheet S at the fixing position 95. When the speed difference becomes smaller, the amount of color shift becomes smaller, and therefore, it becomes difficult for the human eye to recognize image quality degradation in the reproduced image. However, the tension applied to the sheet S becomes smaller, and wrinkles easily appear on the sheet S. If the amount of color shift remains below a certain level, the human eye is unable to regard the color shift as image quality degradation in the reproduced image.

In view of this, in this embodiment, the maximum value of the amount of color shift that is not to be recognized as image quality degradation by the human eye (the upper limit value of color shift) is set at 100 μm, and the smallest necessary speed difference for preventing wrinkles on the sheet S is set at 0.1%. A value that is not smaller than 0.1% but is smaller than 1%, which is the speed difference with respect to the upper limit value of color shift, is determined beforehand as the speed difference ΔV. For example, a value of approximately 0.5% is determined as the speed difference ΔV. This value is merely an example, and any optimum value can be selected in accordance with the device configuration.

Referring back to FIG. 1, the sheet surface speed sensor (hereinafter referred to simply as "sensor") 44 is located on the upstream side of the fixing position 45 in the sheet conveying direction, and is also located in a position that is lower than the conveyance pathway (the conveyance path P) of the sheet S and is close to the fixing position 45. The sensor 44 measures the movement speed of the surface on the back side (the side onto which any toner image is not to be transferred) of the sheet S that is nipped and conveyed by the fixing roller 41 and the pressure roller 42. This surface having its movement speed to be measured will be hereinafter referred to as the "sheet surface". The measurement method used herein will be described later.

The sensor 44 measures the movement speed of the sheet surface regularly (every few milliseconds, for example) during the conveyance of the sheet S (or during the winding operation), and transmits the result of the measurement to the general control unit 6.

(2) Structure of the General Control Unit

Figure 3:
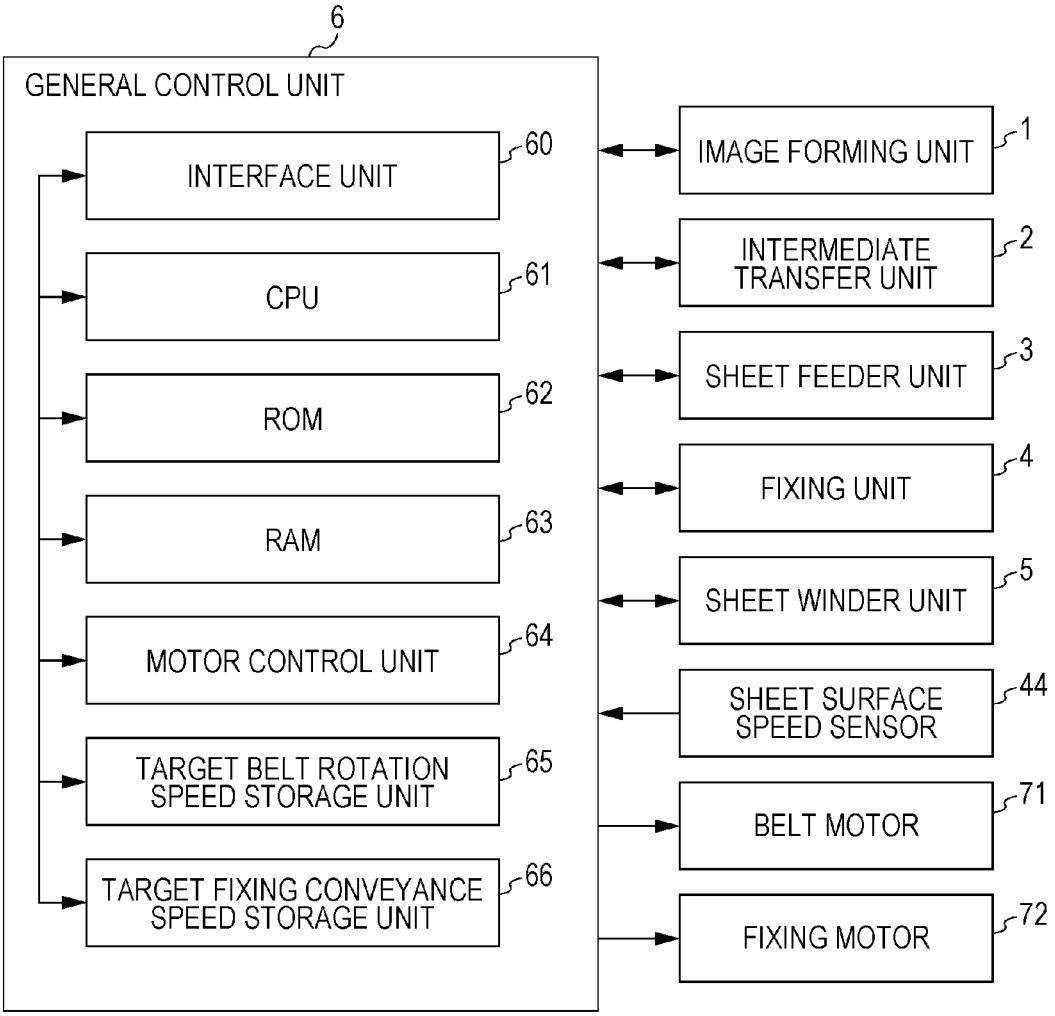
FIG. 3 is a block diagram showing the structure of the general control unit.

FIG. 3 is a block diagram showing the structure of the general control unit 6.

As shown in FIG. 3, the general control unit 6 includes a communication interface unit 60, a CPU 61, a ROM 62, a RAM 63, a motor control unit 64, a target belt rotation speed storage unit 65, and a target fixing conveyance speed storage unit 66, which are principal components of the general control unit 6. These components are designed to be able to exchange signals and data with one another.

The communication interface unit 60 is an interface such as a LAN card or a LAN board for connecting to a network, or a LAN in this case. The communication interface unit 60 receives print job data transmitted from an external terminal via the LAN.

The ROM 62 stores a program or the like for executing a print job.

The CPU 61 reads the necessary program from the ROM 62, and controls the image forming unit 1, the intermediate transfer unit 2, the sheet feeder unit 3, and the fixing unit 4, to execute the print job based on the received print job data. The RAM 63 serves as a work area for the CPU 61.

The target belt rotation speed storage unit 65 stores information indicating the target rotation speed of the belt motor 71 (the target belt rotation speed) for rotatively driving the intermediate transfer belt 21. The target belt rotation speed is the rotation speed of the belt motor 71 at the time when the belt peripheral speed Vb of the rotating intermediate transfer belt 21 becomes equal to the peripheral speed of the photosensitive drums 11Y through 11K (or the system speed, which is a constant value).

The target fixing conveyance speed storage unit 66 stores information indicating the target speed of conveyance of the sheet S being nipped and conveyed by the fixing roller 41 and the pressure roller 42 (this target speed will be hereinafter referred to as the target fixing conveyance speed).

This target fixing conveyance speed is a sheet conveyance speed Vt that is higher than the belt peripheral speed Vb of the intermediate transfer belt 21 by the above mentioned speed difference ΔV. The target belt rotation speed and the target fixing conveyance speed are determined beforehand through experiments or the like, and are stored in the respective storage units.

The motor control unit 69 performs feedback control on the rotation speeds of the belt motor 71 and the fixing motor 72 separately from each other. Specifically, the motor control unit 64 measures the current rotation speed of the belt motor 71 in accordance with a detection signal supplied from a sensor (not shown) that detects the number of rotations of the rotary shaft of the belt motor 71. The rotation speed (the measured value) of the belt motor 71 is then compared with the target belt rotation speed (the target value) stored in the target belt rotation speed storage unit 65.

If the measured value is not equal to the target value, the rotation speed of the belt motor 71 is adjusted so that the measured value becomes equal to the target value. If the measured value is smaller than the target value, for example, the rotation speed of the belt motor 71 is increased. If the measured value is greater than the target value, the rotation speed of the belt motor 71 is lowered. If the measured value is equal to the target value, the current rotation speed of the belt motor 71 is maintained. This comparison between a measured value and the target value is repeated regularly, or every few milliseconds, for example.

The control is performed to slightly increase or decrease a measured value with respect to the target value. A transfer function or the like for the feedback control is set beforehand so that the increase/decrease stays within the design tolerance with respect to the system speed. With this, the intermediate transfer belt 21 can rotate stably at the peripheral speed Vb.

The belt motor 71 may not be subjected to the feedback control. Any kind of control may be performed to rotate the intermediate transfer belt 21 at the constant peripheral speed Vb. For example, a stepping motor may be used as the belt motor 71, and control may be performed by supplying a driving pulse for rotating the intermediate transfer belt 21 at the constant peripheral speed Vb.

Control on the fixing motor 72 will be described below, with reference to FIG. 4.

(3) Control on the Fixing Motor 72

Figure 4:
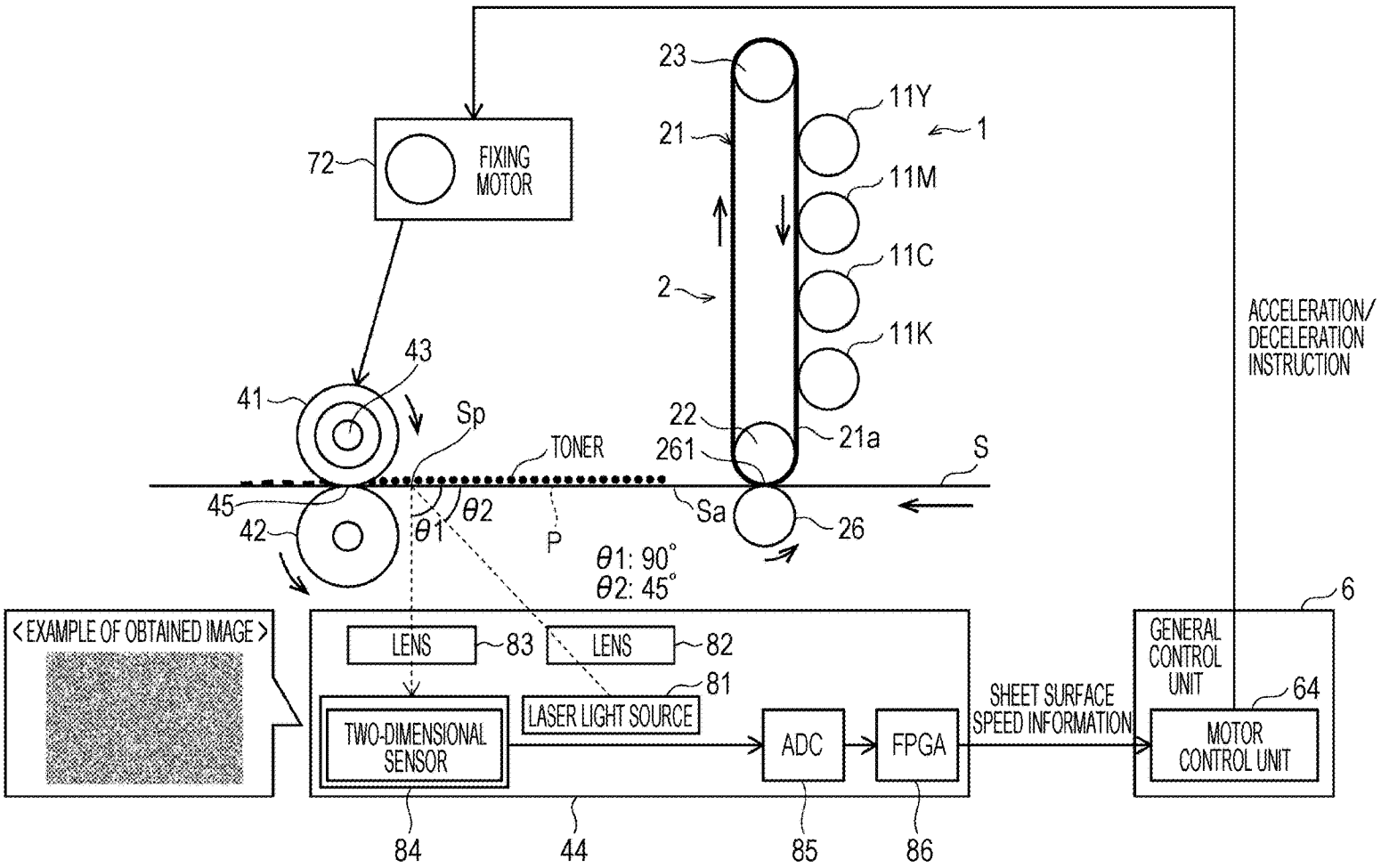
FIG. 4 is a diagram for explaining the details of control on the fixing motor.

FIG. 4 is a diagram for explaining the details of the control on the fixing motor 72, and also shows the structure of the sensor 44. In FIG. 4, the structures of the image forming unit 1 and the intermediate transfer unit 2 are simplified.

As shown in FIG. 4, the sensor 44 includes a laser light source 81, lenses 82 and 83, a two-dimensional sensor 84, an ADC 85, and an FPGA 86. The sensor 44 is a con-contact sensor that measures the movement speed of a surface Sa of the sheet S being conveyed, using a speckle pattern.

The laser light source 81 emits laser light toward a predetermined irradiation position Sp in the conveyance path P. The laser light emitted from the laser light source 81 passes through the lens 82, and irradiates the surface Sa of the sheet S being conveyed. The irradiation position Sp of the laser light in the conveyance path P in the sheet conveying direction is a position located on the upstream side of the fixing position 45 in the sheet conveying direction and at a predetermined distance La (=the radius of the pressure roller 42+an attachment error of the sensor 44) from the center of the fixing position 45 in the sheet conveying direction.

The attachment error of the sensor 44 is the attachment error that occurs in the sheet conveying direction when the sensor 44 is attached to the housing (not shown) of the apparatus. The attachment error may be 0. The above mentioned predetermined distance La is a rough guide, and the irradiation position Sp is preferably set at the position closest possible to the fixing position 45. The angle θ2 between the laser light entering the surface Sa of the sheet S and the surface Sa of the sheet S is 45 degrees in FIG. 4. However, the angle θ2 is not limited to 45 degrees, and may be any angle between 20 degrees and 45 degrees, for example.

The surface Sa of the sheet S is a rough surface that has minute irregularities when microscopically observed. When laser light (coherent light) is emitted onto this rough surface, a granular pattern called a speckle pattern appears. A speckle pattern appears, because different phases of light overlap one another as beams of laser light randomly reflected and scattering from the respective spots on the rough surface overlap one another.

Of the laser light generated from the speckle pattern, light reflected at an angle θ1, which is 90 degrees, with respect to the surface Sa of the sheet S passes through the lens 83 located immediately below the irradiation position Sp, and is gathered onto the detection surface of the two-dimensional sensor 84 serving as the light receiving unit. The example of an obtained image shown in the drawing is an expanded view of an example of an obtained image of the speckle pattern of the laser light gathered onto the detection surface of the two-dimensional sensor 84. With this structure, the speckle pattern formed on the surface Sa of the sheet S located immediately above the detection surface of the two-dimensional sensor 84 can be detected from the detection surface of the two-dimensional sensor 84.

The speckle pattern does not change unless the sheet S moves, but does change when the sheet S moves. As the sheet S is conveyed, the irregular portions on the rough surface passing through the laser irradiation position Sp change at each point of time, and the overlapping state of the randomly reflected laser light also changes at each point of time.

The rate of change in the speckle pattern depends on the movement speed of the sheet S, and the amount of laser light (the intensity of light) received on the detection surface of the two-dimensional sensor 84 also varies with change in the speckle pattern. Accordingly, the movement speed of the surface of the sheet S can be measured by detecting temporal change in the amount of laser light received on the detection surface of the two-dimensional sensor 84. In view of this, the laser irradiation position Sp on the sheet S is also the position of measurement of the sheet surface movement speed.

Although the two-dimensional sensor 84 is located immediately below the irradiation position Sp in the example structure shown in FIG. 4, the position of the two-dimensional sensor 84 is not limited to that. The two-dimensional sensor 84 may be located in any position where it is possible to receive light reflected at 90 degrees with respect to the surface Sa of the sheet S, the reflected light being of laser light emitted onto the surface Se. It is possible to measure not only light reflected at 90 degrees with respect to the surface Sa, but also light reflected at any angle at which the rate of change in the speckle pattern can be detected. The angle may be an angle specified in JIS P8148 and Z8722, for example.

The two-dimensional sensor 84 outputs an analog voltage signal in accordance with the amount of laser light gathered and received on the detection surface thereof to the ADC 85 regularly, or every few milliseconds, for example.

The ADC (Analog-to-Digital Converter) 85 converts the analog voltage signal output from the two-dimensional sensor 84 into a digital signal every time the analog voltage signal is received regularly, and outputs the converted digital signal to the FPGA 86.

The FPGA (Field Programmable Gate Array) 86 receives the digital signal output from the ADC 85, detects temporal change in the amount of received laser light detected by the two-dimensional sensor 84, calculates the movement of the sheet S per unit time from the detected temporal change in the amount of received laser light, and determines the current speed of conveyance of the surface Sa of the sheet S (the sheet surface movement speed), or the speed of conveyance of the sheet S being conveyed by the fixing roller 41, from the calculation result. The FPGA 86 then outputs the determined sheet surface movement speed (the measured value) as the sheet surface speed information to the motor control unit 64 of the general control unit 6.

While the fixing roller 41 is rotating, the motor control unit 64 obtains, from the sheet surface speed information output from the sensor 44, the sheet surface movement speed of the sheet S currently being nipped and conveyed by the fixing roller 41 and the pressure roller 42. In accordance with the obtained sheet surface movement speed (the measured value), the motor control unit 64 controls the rotation speed of the fixing roller 41 so that the speed of conveyance of the sheet S reaches the target fixing conveyance speed (the target value) Vt stored in the target fixing conveyance speed storage unit 66.

Specifically, the sheet surface movement speed (the measured value) is compared with the target fixing conveyance speed (the target value) Vt. If the measured value is not equal to the target value, an acceleration/deceleration instruction is issued to fixing motor 72 so that the measured value becomes equal to the target value.

More specifically, if the measured value is smaller than the target value, the fixing motor 72 is instructed to lower the rotation speed. If the measured value is greater than the target value, the fixing motor 72 is instructed to increase the rotation speed. If the measured value is equal to the target value, the fixing motor 72 is instructed to maintain the current rotation speed. The fixing motor 72 is repeated instructed in this manner regularly, or every few milliseconds, for example. In accordance with such an acceleration/deceleration instruction, the fixing motor 72 increases/decreases or maintains the number of rotations. With this, the speed of conveyance of the sheet S being nipped and conveyed by the fixing roller 41 and the pressure roller 42 can stabilize at the target fixing conveyance speed Vt.

As the sheet surface movement speed is directly measured by the sensor 44 in the above manner, the rotation speed of the fixing motor 72 can be lowered by making the measured value greater than the target value, even if the peripheral speed of the fixing roller 41 becomes higher over time due to thermal expansion of the fixing roller 41. Also, even if the fixing roller 41 contracts due to a temperature drop after thermal expansion, the rotation speed of the fixing motor 72 can be increased by making the measured value smaller than the target value.

In the above manner, the speed of conveyance of the sheet S being nipped and conveyed by the fixing roller 41 and the pressure roller 42 can be maintained at the target speed Vt, even if the peripheral speed of the fixing roller 91 fluctuates due to fluctuation in the roller diameter caused by thermal expansion of the fixing roller 41 and the pressure roller 42 while the fixing roller 41 is rotating.

The fixing motor 72 is not necessarily a DC brushless motor, but may be some other kind of motor, such as a stepping motor. The rotation speed of such a stepping motor or the like may be increased or decreased so that the speed of conveyance of the sheet S reaches the target speed Vt in accordance with a speed difference between the value of the sheet surface movement speed measured by the sensor 44 and the target speed Vt.

(4) Sheet Conveyance Control in an Example and a Comparative Example

Figure 5:
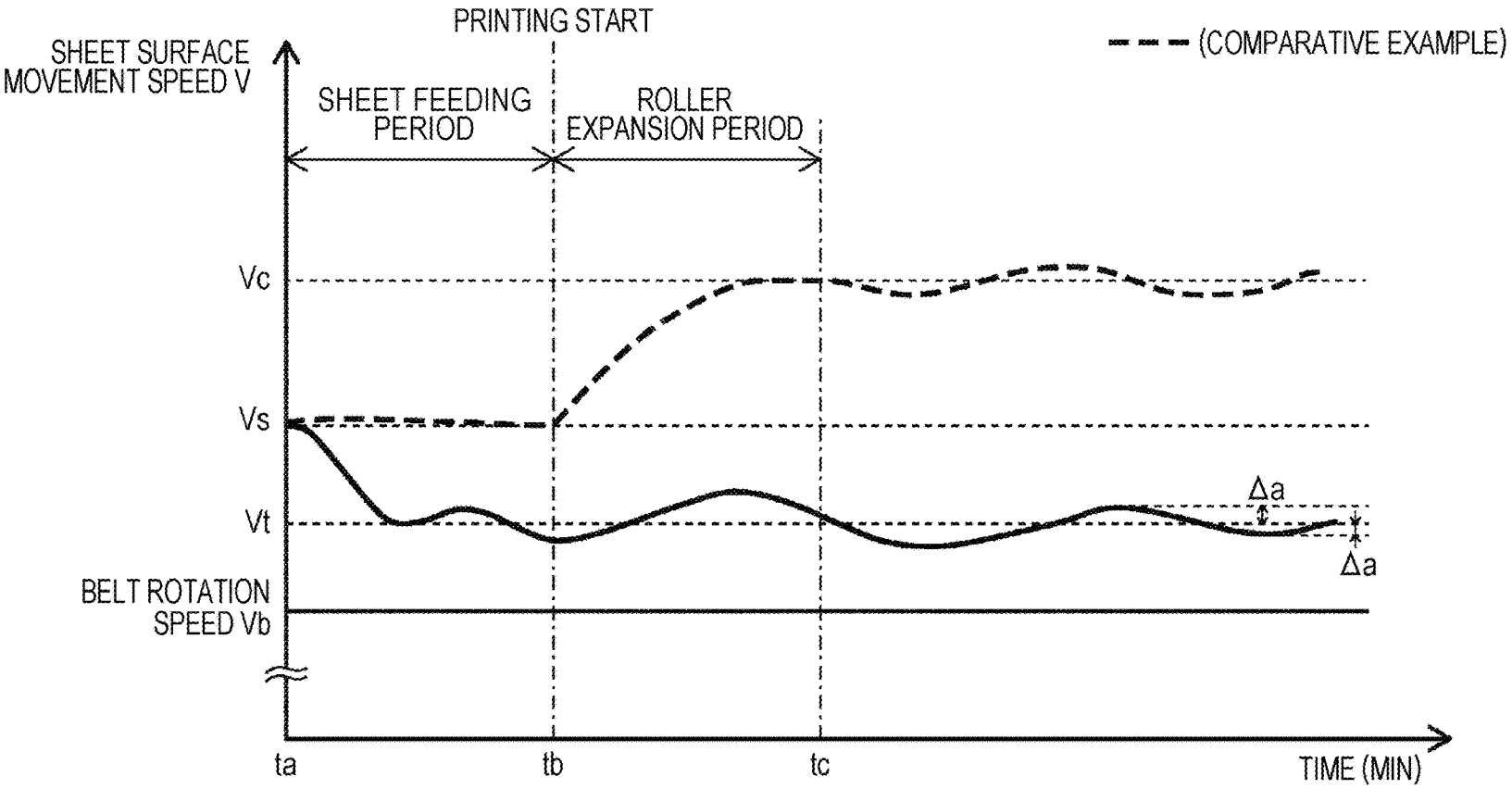
FIG. 5 is a graph showing changes in the sheet surface movement speed during a print operation in a case where control according to an example is performed, and in a case where control according to a comparative example is performed.

FIG. 5 is a graph showing changes in the sheet surface movement speed V during print operations. In one of the print operations, the rotation of the fixing motor 72 is controlled with the sensor 94 of this embodiment (an example). In the other one of the print operations, the rotation speed of the rotary shaft of the fixing motor 72 is maintained at a target speed by feedback control (a comparative example). The feedback control in the comparative example is the same as the above described feedback control on the belt motor 71.

Here, a sheet feeding period (between time points to and tb) is a period of time during which a certain amount of the sheet S is wound up before printing is started, and heating of the fixing roller 91 by the heater 43 of the fixing unit 4 has not been started yet in this period.

A roller expansion period (between time points tb and tc) is the period of time during which the fixing roller 41 thermally expands as the heating is started by the heater 43 after the start of printing (the time point tb). The roller expansion period is the period of time from the start of thermal expansion of the fixing roller 41 due to the heating performed by the heater 43 till the stop of the thermal expansion at a certain size after the temperature of the fixing roller 41 is increased to and maintained at the fixing temperature. The roller expansion period varies depending on the material of the fixing roller 41 and the degree of the heating performed by the heater 93, but often falls into a range of several minutes to several tens of minutes.

A speed Vs is higher than the belt peripheral speed Vb by a predetermined speed difference X %. A speed Vt is equivalent to the above described target fixing conveyance speed Vt, and is higher than the belt peripheral speed Vb by a predetermined speed difference Y % (<X %). The speed differences X and Y are equivalent to the speed differences shown in FIG. 2, and are in the relationship, $0.1 \leq Y < X < 1$. The speed difference X %, or the speed Vs, is the upper limit value of a sheet surface movement speed with which the lowest allowable image quality can be maintained in an image after secondary transfer.

In the comparative example represented by the dashed line, the target speed of the sheet surface movement speed V is set at Vs. In the example represented by the solid line, the target speed of the sheet surface movement speed V is set at Vt.

In the comparative example, feedback control is performed so that the fixing motor 72 rotates at a predetermined speed equivalent to the target speed Vs. With this, the sheet surface movement speed stabilizes at Vs during the sheet feeding period.

After the sheet feeding period ends and a print operation starts (the time point tb), however, the fixing roller 41 thermally expands over time during the roller expansion period (between the time points tb and tc), and the sheet surface movement speed V becomes higher due to the increase in the roller diameter caused by the thermal expansion, even though the feedback control is performed so that the fixing motor 72 rotates at the predetermined speed described above. In the graph, the sheet surface movement speed stabilizes at Vc (>Vs).

In the comparative example, the difference between the sheet surface movement speed V and the belt peripheral speed Vb becomes larger, and color shift due to transfer shift at the secondary transfer position 261 easily occurs.

In the example, on the other hand, after the start (the time point ta) of the sheet feeding period, the target speed of the sheet surface movement speed V is set at Vt, the current movement speed V of the surface Sa of the sheet S is measured by the sensor 44, and feedback control is performed on the fixing motor 72 so that the measured value becomes equal to the target speed Vt. As a result, after the start of printing (the time point tb), the sheet surface movement speed V stabilizes while slightly fluctuating with respect to the target speed Vt by a very small amount Δa, regardless of whether the fixing roller 41 thermally expands.

Being in the relationship, belt peripheral speed Vb<target speed Vt<Vs, the speed Vs serves as the upper limit value of the sheet surface movement speed with which the lowest allowable image quality can be maintained in an image after secondary transfer, as described above.

In view of this, the target speed of the sheet surface movement speed V should be set at Vt, the speed variation Δa on the positive side should fall within the range of (Vs−Vt) with respect to the target speed Vt, and the speed variation Δa on the negative side should fall within the range of (Vt−Vb) with respect to the target speed Vt. Under such conditions, transfer shift can be prevented while tension is applied to the sheet portion Sd, even if the sheet surface movement speed V fluctuates to the limit of variation. A transfer function or the like for the feedback control is set beforehand so that the speed variation Δa stays within the design tolerance.

In a case where the speed variation La hardly affects the quality of a reproduced image, the target speed Vt may be equal to or smaller than Vs. Also, the target speed Vt may be determined within a predetermined range that is above the belt peripheral speed Vb but include values equal to or lower than the upper limit value Vs.

(5) Sheet Conveyance Control to be Performed by the Motor Control Unit.

FIG. 6 is a flowchart showing the details of sheet conveyance control to be performed by the motor control unit 64, and this control is performed on each print job.

First, the fixing roller 41 is started to rotate so that the peripheral speed of the fixing roller 41 becomes equal to the sheet surface movement speed Vs (see FIG. 5) (step S1). This step is equivalent to the start (the time point ta) of the sheet feeding period shown in FIG. 5.

The sheet surface movement speed V measured by the sensor 44 is then obtained (step S2), and the rotation speed of the fixing roller 41 is controlled so that the sheet surface movement speed becomes equal to the target speed Vt (see FIG. 5). Specifically, a check is made to determine whether the obtained sheet surface movement speed V is not lower than (Vt−Δa) and not higher than (Vt+Δa) (step S3). This Δa is equivalent to the Δa shown in FIG. 5.

If the obtained sheet surface movement speed V is determined not to be in the relationship, (Vt−Δa)≤V≤(Vt+Δa) ("NO" in step S3), but is in the relationship, (Vt+Δa)<V ("YES" in step S4), the current rotation speed of the fixing roller 41 is decreased by the amount equivalent to the speed difference (=V−Vt) (step S5), and the operation returns to step S2. If the obtained sheet surface movement speed V is in the relationship, V<(Vt−Δa) ("NO" in step S4), on the other hand, the current rotation speed of the fixing roller 41 is increased by the amount equivalent to the speed difference (=Vt−V) (step S6), and the operation returns to step S2. Steps S2 and S3 are then carried out again.

During the period immediately after the start (the time point ta) of the sheet feeding period shown in FIG. 5, the relationship, (Vt+Δa)<V, is achieved, and accordingly, the sheet surface movement speed V becomes lower as the rotation speed of the fixing roller 41 becomes lower. Steps S2 through S6 are repeated until the relationship, (Vt−Δa) ≤V≤(Vt+Δa), is achieved.

If the obtained sheet surface movement speed V is determined to be in the relationship, (Vt−Δa)≤V≤(Vt+Δa) ("YES" in step S3), the sheet surface movement speed V is regarded as equal to the target speed, and the rotation speed of the fixing roller 41 is determined at the current speed and is maintained at the determined speed until the end (the time point tb in FIG. 5) of the sheet feeding period (step S7).

After it is determined that a print operation has not been started ("NO" in step S8), and printing is started (step S9) as the sheet feeding period ends (the time point tb), sampling is performed for a certain period (a few seconds, for example) on the sheet surface movement speed V measured by the sensor 44, and the average value Vave is calculated (step S10). The calculation of the average value Vave is equivalent to the acquisition of the initial measured value of the sheet surface movement speed at the start of the print operation.

A check is made to determine whether a certain time Td (a few tens of seconds, for example) has passed since the start of the printing (step S11). Before the certain time Td passes, the rotation speed of the fixing roller 41 is maintained as determined during the sheet feeding period immediately before the start of the print operation. When it is determined that the certain time Td has passed ("YES" in step S11), the sheet surface movement speed Vf measured by the sensor 44 at the point of time is acquired, and the speed difference Δb between the acquired speed Vf and the above average value Vave (the sheet surface movement speed at the start of the printing) is calculated (step S12). At this point of time, the rotation speed of the fixing roller 41 is maintained at the speed determined in step S7.

A check is made to determine whether the calculated speed difference Δb is 0 (step S13). If the calculated speed difference Δb is determined not to be 0 or there exists a speed difference ("NO" in step S13), and if the calculated speed difference Δb is greater than 0 ("YES" in step S14), the sheet surface movement speed V is higher than the average value Vave by the speed difference Δb, and therefore, the current rotation speed of the fixing roller 41 is decreased by the amount equivalent to the speed difference Δb (step S15), and the operation returns to step S12.

If the calculated speed difference Δb is smaller than 0 ("NO" in step S14), the sheet surface movement speed V is lower than the average value Vave by the speed difference Δb, and therefore, the current rotation speed of the fixing roller 41 is increased by the amount equivalent to the speed difference Δb (step S16), and the operation returns to step S12. As the current rotation speed of the fixing roller 41 increased or decreased to cancel out the speed difference Δb, the rotation speed of the fixing roller 41 is updated.

Step S12 is carried out again, and, if the speed difference Δb is not 0 ("NO" in step S13), step S14 and the following steps are carried out. Steps S12 through S16 are repeated until the speed difference Δb is determined to be 0. In this manner, the sheet surface movement speed V is returned to the initial measured value of the sheet surface movement speed measured at the start of the print operation.

After the start (the time point tb) of the printing, or particularly during the roller expansion period (between the time points tb and tc), the sheet surface movement speed V continues to increase due to thermal expansion of the fixing roller 41, but the acceleration is cancelled out by the deceleration in step S15. Thus, the speed of conveyance of the sheet S can be easily stabilized.

If the speed difference Δb is determined to be 0 ("YES" in step S13), the current rotation speed of the fixing roller 41 is maintained (step S17). A check is then made to determine whether a certain time Te has passed (step S18). This certain time Td may be 10 minutes, for example. During the certain time Te, the rotation speed of the fixing roller 41 is maintained as in step S17.

When the certain time Te has passed ("YES" in step S18), a check is made to determine whether the printing is to end (step S19). If the printing is not to end yet ("NO" in step S19), the operation returns to step S2, and step S2 and the following steps are again carried out.

As steps S2 through S7 are carried out for the second time, even if the current sheet surface movement speed V is outside the range of (target speed Vt−Δa) to (target speed Vt+Δa), the rotation speed of the fixing roller 41 is adjusted to cancel out the speed difference.

If it is determined in step S8 that a print operation is being performed ("YES" in step S8), the operation moves on to step S10, and step S10 and the following steps are carried out. At this point of time, the average value Vave of the sheet surface movement speed calculated in step S10 is the value calculated in accordance with the result of the measurement carried out immediately after the speed difference between the measured value of the sheet surface movement speed and the target speed Vt is adjusted to fall within the above described range in steps S2 through S7, and accordingly, the average value Vave is equal to or very close to the target speed Vt.

Steps S2 through S18 are repeated until the printing ends. When it is determined that the printing is to end ("YES" in step S19), the rotation of the fixing roller 41 is stopped (step S20), and this sheet conveyance control comes to an end.

If the certain times Td and Te are too short, the number of times the rotation speed control is performed on the fixing roller 41 per unit time becomes too large, resulting in an increased processing load on the CPU 61 and the like. If the certain times Td and Te are too long, the variation in the sheet surface movement speed might expand outside the range of the belt rotation speed Vb to the upper limit value Vs. In view of this, appropriate durations are determined beforehand in accordance with the device configuration through experiments so that the variation in the sheet surface movement speed can be minimized while the processing load on the CPU 61 and the like is reduced.

In the above described sheet conveyance control, the process of controlling the rotation speed of the fixing roller 41 in accordance with the difference between the measured value of the sheet surface movement speed and the target speed Vt (steps S2 through S7), and the process of controlling the rotation speed of the fixing roller 41 in accordance with the difference between the average value Vave of the measured values of the sheet surface movement speed measured immediately after the above process and the measured value of the sheet surface movement speed thereafter (steps S10 through S17) are alternately performed during a job operation. However, the present invention is not limited to that.

For example, during a print operation, a check may be made to determine whether there exists a difference between a measured value of the sheet surface movement speed and the target speed Vt every time a measured value of the sheet surface movement speed is acquired after a certain time interval (a few tens of milliseconds, for example). If there exists a speed difference, the rotation speed of the fixing roller 41 may be controlled so that the sheet conveyance speed becomes equal to the target speed Vt (or the speed difference is cancelled out).

In the above described sheet conveyance control, the rotation speed of the fixing motor 72 is controlled in accordance with the result of measurement carried out by the sensor 44 during the time from the start of a print operation till the end thereof. However, the present invention is not limited to that. To prevent transfer shift, the above described control may be performed while the sheet S being conveyed is in contact with at least the secondary transfer roller 26 and the fixing roller 41.

For example, after the bottom end of the sheet S in the conveying direction passes through the secondary transfer position 261, discharge control, instead of the above described control, may be performed to rotate the fixing motor 72 at a predetermined speed slightly higher than the previous speed. In this manner, the time required for the bottom end of the sheet S to be discharged from the apparatus can be shortened.

In this discharge control, it is necessary to sense that the bottom end of the sheet S in the conveying direction has passed through the secondary transfer position 261, or to recognize the current location of the sheet S in the conveyance path P. The current location of the sheet S can be acquired in accordance with a result of detection performed by one or more sheet detection sensors (not shown) provided along the conveyance path P, for example. Specifically, the current location of the sheet S being conveyed in the conveyance path P can be detected by monitoring for an output of a detection signal indicating a sheet passing through the installation site of each of the sensors at regular intervals (every few milliseconds, for example) during a print operation.

If the current location of the sheet S being conveyed in the conveyance path P is acquired, the period from the time when the top end of the single sheet S in the conveying direction reaches the fixing position 45 till the bottom end of the sheet S passes through the secondary transfer position 261 can be regarded as the "period during which the sheet being conveyed is in contact with both the secondary transfer roller 26 and the fixing roller 41", and the above described control can be performed.

As described above, in this embodiment, the sheet surface movement speed V of the sheet S currently being conveyed by the fixing roller 41 is measured by the sensor 44, and the rotation speed of the fixing motor 72 is controlled in accordance with the measured value so that the speed of conveyance of the sheet S becomes equal to the target speed Vt. In this manner, the sheet S can be conveyed at the target speed Vt, even if the fixing roller 41 thermally expands during a print operation. Thus, both transfer shift on the sheet S at the secondary transfer position 261 and wrinkles on the sheet S at the fixing position 45 can be prevented.

In the above described example structure, the laser light source 81 that emits laser light is provided in the sensor 44. However, the present invention is not limited to that structure. Instead of the laser light source 81, it is possible to use a light source that emits light beams with coherence high enough to generate a speckle pattern.

Second Embodiment

In the above described example structure according to the first embodiment, the sensor 44 that measures sheet surface movement speed by using a speckle pattern has been described. A second embodiment differs from the first embodiment in using a sensor that measures sheet surface movement speed by taking advantage of the Doppler effect. To avoid unnecessary repetitions of the same explanation, the same processes as those in the first embodiment will not be explained below, and the same components as those of the first embodiment are denoted by the same reference numerals as those used in the first embodiment.

Figure 7:
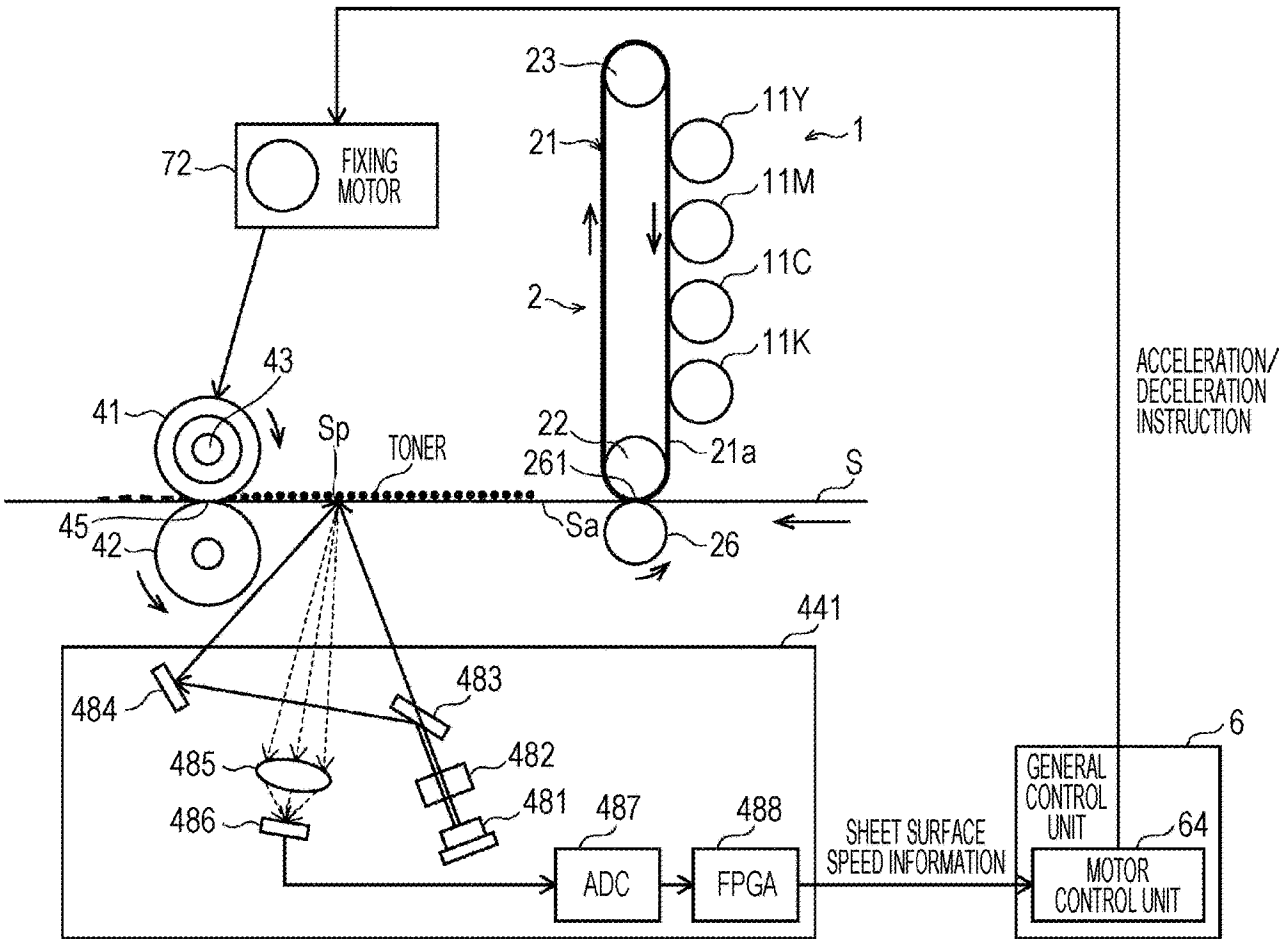
FIG. 7 is a diagram showing an example structure of a sensor according to a second embodiment.

FIG. 7 is a diagram showing an example structure of the sensor according to the second embodiment.

As shown in FIG. 7, a sensor 441 includes a laser light source 481, a collimator lens 482, a beam splitter 483, a mirror 484, a lens 485, a photoelectric element 486, an ADC 487, and an FPGA 488.

Laser light emitted from the laser light source 481 is turned into parallel light by the collimator lens 482, and is divided into two laser beams by the beam splitter 483. One of the laser beams travels straight through the beam splitter 483, further travels from the upstream side in the sheet conveying direction to an irradiation position Sp in a conveyance path P, and is reflected by the surface Sa of the sheet S at the irradiation position Sp.

The other one of the laser beams is deflected while traveling through the beam splitter 483, is reflected by the mirror 484, travels from the downstream side in the sheet conveying direction to the irradiation position Sp in the conveyance path P, and is reflected by the surface Sa of the sheet S at the irradiation position Sp.

On the sheet S being conveyed, one of the laser beams is emitted to the irradiation position Sp from the upstream side in the sheet conveying direction, and the other one of the laser light is emitted to the irradiation position Sp from the downstream side in the sheet conveying direction. As a result, the other one of the reflected light beams turns into light having a different wavelength from the one of the reflected light beams, because of the Doppler effect.

The reflected light beams are gathered onto the photoelectric element 486 through the lens 485 provided below the irradiation position Sp. The photoelectric element 486 detects a difference in wavelength between the received reflected light beams by conducting heterodyne detection, and outputs an analog voltage in accordance with the difference. The difference caused in wavelength between the reflected light beams by the Doppler effect changes with the speed of conveyance of the sheet S, and accordingly, the voltage output from the photoelectric element 486 indicates the current speed of conveyance of the sheet S.

The voltage output from the photoelectric element 486 is input to the FPGA 488 via the ADC 487. The ADC 487 and the FPGA 488 have the same functions as the ADC 85 and the FPGA 86 described above. After the ADC 987 performs analog-to-digital conversion on the voltage output from the photoelectric element 486, the FPGA 488 determines the speed of conveyance of the sheet S (the measured value) in accordance with the converted voltage, and outputs the measured value as the sheet surface speed information to the motor control unit 64 of the general control unit 6.

With such a structure including the sensor 491 that takes advantage of the Doppler effect, the sheet surface movement speed V of the sheet S can be measured in a non-contact manner.

Third Embodiment

In the above described example structure according to the first embodiment, the number of rotations of the fixing motor 72 is controlled in accordance with the result of sheet surface movement speed measurement carried out by the sensor 44, so that the sheet conveyance speed becomes equal to the target fixing conveyance speed Vt. A third embodiment differs from the first embodiment in that the peripheral speed of the intermediate transfer belt 21 is measured with another sensor, and the rotation speed of the belt motor 71 is controlled in accordance with the result of the measurement so that the intermediate transfer belt 21 can rotate at a target speed (system speed) in a more stable manner.

Figure 8:
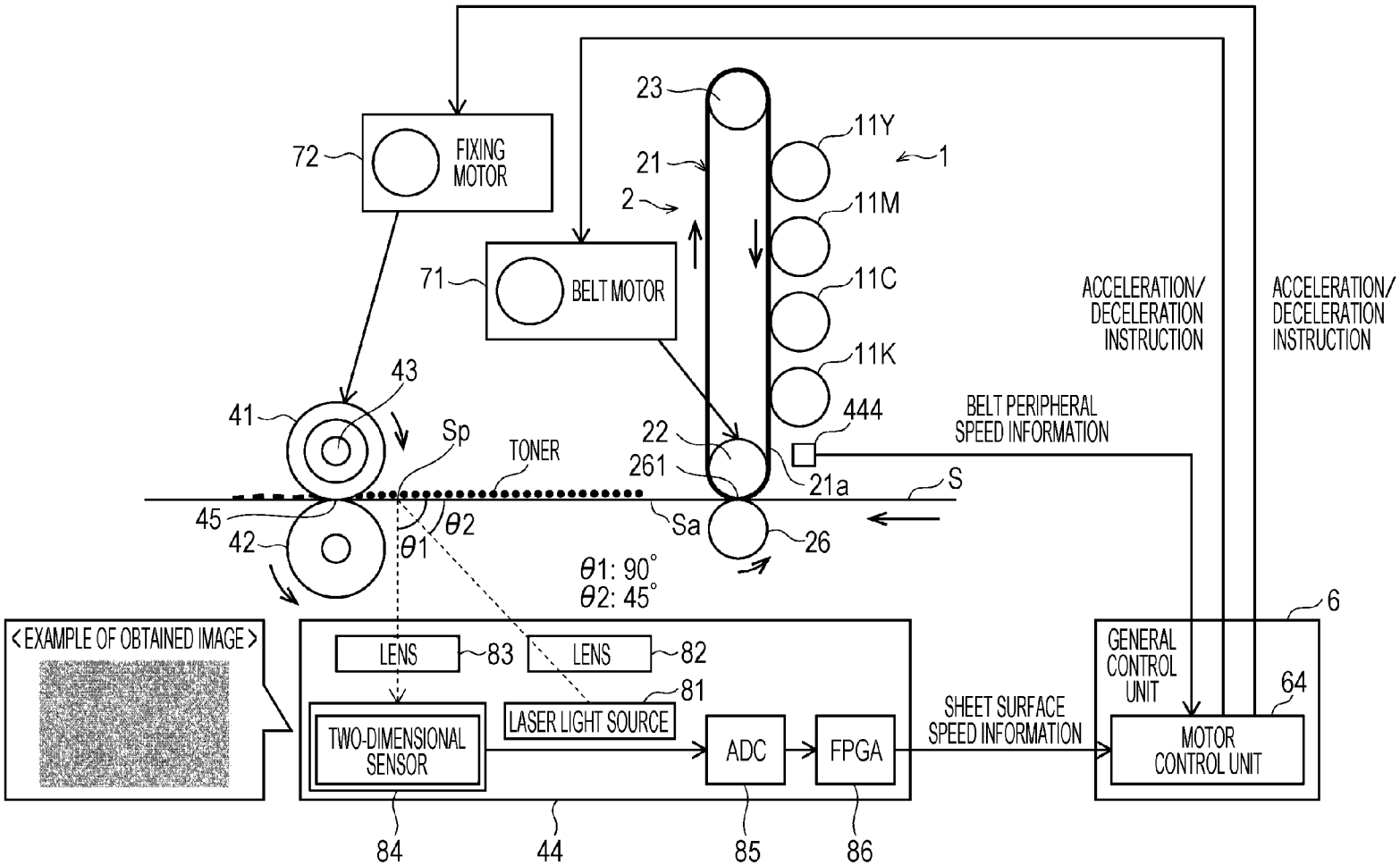
FIG. 8 is a diagram showing an example structure in which the number of rotations of the belt motor is further controlled according to a third embodiment.

FIG. 8 is a diagram showing an example structure in which the number of rotations of the belt motor 71 is further controlled according to the third embodiment.

As shown in FIG. 8, a belt peripheral speed sensor (hereinafter referred to simply as "sensor") 444 is provided in a space that is close to the intermediate transfer belt 21, and is located on the downstream side of the photosensitive drum 11K and on the upstream side of the secondary transfer position 261 in the belt rotating direction.

This sensor 444 is a non-contact sensor that has the same function as the sensor 44 and uses a speckle pattern. Specifically, the sensor 444 emits laser light from a laser light source 81 to the peripheral surface of the intermediate transfer belt 21 while the intermediate transfer belt 21 is rotating. The sensor 444 then receives, with a two-dimensional sensor 84, reflected light having the speckle pattern generated at the time of reflection from the belt peripheral surface 21*a*. The sensor 444 measures the peripheral speed (the peripheral surface movement speed) of the intermediate transfer belt 21, and outputs the measured value as belt peripheral speed information to the motor control unit 64 of the general control unit 6.

The motor control unit 64 performs acceleration/deceleration control on the number of rotations of the belt motor 71 in accordance with the received belt peripheral speed information, so that the peripheral surface movement speed of the intermediate transfer belt 21 becomes equal to the target speed (the system speed). In this control, the measured value also becomes closer to the target speed while slightly fluctuating with respect to the target speed, as described above. The fluctuation is controlled to fall within the design tolerance with respect to the system speed as in the above described embodiments.

With this structure, the peripheral surface movement speed of the intermediate transfer belt 21 can be directly measured, and the rotation of the intermediate transfer belt 21 can be controlled in accordance with the measured value.

Unlike the fixing roller 41 of the fixing unit 4, the intermediate transfer belt 21 does not thermally expand due to the heating performed by the heater 43. In a case where the diameter of the driving roller 22 becomes gradually smaller due to abrasion over a long period of time, however, the peripheral speed of the driving roller 22 becomes gradually lower. In view of this, the number of rotations of the belt motor 71 is controlled in accordance with the measured value of the peripheral surface movement speed of the intermediate transfer belt 21, so that the peripheral speed of the intermediate transfer belt 21 can be stably maintained at the system speed for a longer period of time.

Control can also be performed in accordance with a result of measurement of the peripheral surface movement speed of the intermediate transfer belt 21 with the sensor 444 during printing and a result of measurement of the sheet surface movement speed with the sensor 44. This control can minimize variation in the speed difference between the peripheral surface movement speed of the intermediate transfer belt 21 and the sheet surface movement speed.

Specifically, where Vp (=Vb) represents the target speed (the system speed) of the peripheral surface movement speed of the intermediate transfer belt 21, Vq represents the measured value of the peripheral surface movement speed of the intermediate transfer belt 21 measured by the sensor 444, and Vr represents the value obtained by subtracting Vp from Vq, the rotation speed of the fixing motor 72 can be controlled so that the measured value Vta of the sheet surface movement speed measured by the sensor 44 becomes equal to the value obtained by adding Vr to the target value (the reference value) Vt (see FIG. 5) of the sheet surface movement speed.

The above target speed (the reference value) Vt is the original target speed of the sheet surface movement speed at the time when the peripheral surface movement speed of the intermediate transfer belt 21 is equal to the target speed Vp. In view of this, performing the above described control is equivalent to updating the target speed of the sheet surface movement speed with the value obtained by adding Vr (=Vq−Vp) to the reference value Vt every time obtaining the value Vq measured with the sensor 444.

In this case, the difference between the current peripheral surface movement speed of the intermediate transfer belt 21 and the updated target speed of the sheet surface movement speed becomes equal to the difference ΔV between the belt peripheral speed Vb (=Vp) shown in FIG. 5 and the target speed Vt (the reference value) of the sheet surface movement speed. In view of this, the rotation of the fixing roller 41 is still controlled so that the sheet surface movement speed becomes equal to a target speed determined beforehand with respect to the peripheral speed of the intermediate transfer belt 21.

When the measured value Vq of the peripheral surface movement speed of the intermediate transfer belt 21 becomes slightly greater than the target speed (the system speed) Vp within the tolerance, the sheet surface movement speed becomes higher than the original target speed Vt accordingly. When the measured value Vq becomes slightly smaller than the target speed Vp within the tolerance, the sheet surface movement speed becomes lower than the original target speed Vt accordingly. Control is performed to achieve these adjustments.

As the rotation of the fixing motor 72 is controlled to increase or decrease in accordance with the peripheral speed (the measured value) of the intermediate transfer belt 21 during a print operation as described above, the variation in the difference between the peripheral speed of the intermediate transfer belt 21 and the sheet surface movement speed V can be minimized.

As the variation in the speed difference becomes greater, the quality of a reproduced image due to transfer shift degrades more easily. In view of this, the quality of a reproduced color image can be improved by reducing the variation in the speed difference. The structure according to the third embodiment is preferably used in a so-called production printer or the like that is required to output high-quality reproduced images.

The present invention relates not only to image forming apparatuses, but also to a sheet conveyance method by which the rotation speed of a fixing member such as the fixing roller 41 is controlled in accordance with a result of measurement of the sheet surface movement speed. The present invention may also relate to a program for a computer to implement the method. The program according to an embodiment of the present invention can be recorded on various kinds of computer-readable recording media, such as magnetic disks including magnetic tape and flexible disks, optical recording media including DVD-ROMs, DVD-RAMs, CD-ROMs, CD-Rs, MOs, or PDs, and recording media of flash memory types. The program may be produced and distributed in the form of such recording media, or may be transmitted and supplied as a program via various kinds of wired and wireless networks including the Internet, broadcasts, electrical communication lines, or satellite communications.

<Modifications>

Although embodiments of the present invention have been described so far, the present invention is of course not limited to the above described embodiments, and the modifications described below may be made.

(1) In the above described embodiments, the back surface (the surface on which any toner image is not to be formed) Sa of the sheet S is irradiated with laser light emitted from the sensor 44, and the sheet surface movement speed is measured. However, the present invention is not limited to those embodiments. For example, the sheet surface movement speed may be measured by emitting laser light to the front surface (the surface on which toner images are to be formed) of the sheet S. In such a case, the position of the sensor 44 is determined so that laser light is emitted onto a region in which any toner image is not to be formed on the front surface of the sheet S.

(2) In the above described embodiments, the irradiation position (the position of measurement of the sheet surface movement speed) Sp of laser light emitted onto the surface Sa of the sheet S is located on the upstream side of the fixing position 45 in the sheet conveying direction and at the distance La from the center of the fixing position 45 in the sheet conveying direction. However, the present invention is not limited to those embodiments.

In the conveyance path P, the irradiation position Sp is preferably located on the downstream side of the secondary transfer position 261 in the sheet conveying direction and on the upstream side of the fixing position 45 in the sheet conveying direction. Within this range, the irradiation position Sp is preferably a position where the laser light emitted onto the surface Sa of the sheet S and reflected from the surface Sa is not blocked by the pressure roller 42 (a fixing member), and is also the position closest possible to the fixing position 45 in the sheet conveying direction.

In a case where tension is applied to the sheet S, a position located on the downstream side of the fixing position 45 in the sheet conveying direction may be set as the irradiation position Sp, or a position located on the upstream side of the secondary transfer position 261 in the sheet conveying direction may be set as the irradiation position Sp, for example.

(3) In the above described embodiments, the sensor 44 that uses a speckle pattern or the sensor 444 that uses the Doppler effect is employed as the measuring unit that measures the sheet surface movement speed. However, the present invention is not limited to those embodiments.

For example, it is possible to employ a sensor that detects, with a two-dimensional sensor, a shade pattern of reflected light generated by the minute irregularities on the surface Sa of the sheet S when light beams are emitted from an LED light source onto the sheet S, and measures the sheet surface movement speed in accordance with the change in the amount of received light caused by change in the shade pattern.

In conjunction with a measurement method using the above mentioned speckle pattern or shade pattern, it is possible to employ a sensor that can measure the surface movement speed of the sheet S in a non-contact manner in accordance with the rate of change in the amount of light received from the surface Sa reflecting the light beams emitted onto the surface Sa of the sheet S being conveyed.

Further, the measurement method may be a method for enabling measurement of the sheet surface movement speed in a non-contact manner, and a sensor of some other appropriate type may be used.

(4) In the example structures according to the above described embodiments, the long sheet S (continuous paper) supplied from the rolled paper 33 is conveyed through the apparatus. However, the present invention is not limited to those structures. The present invention can be applied to any structure in which the sheet S being conveyed is in contact with both the secondary transfer roller 26 and the fixing roller 41, or is conveyed between the secondary transfer position 261 and the fixing position 45. For example, the present invention can be applied to a printer through which sheets (cut paper sheets) of a standard size, such as A3 size, are conveyed.

(5) In the example structures according to the above described embodiments, the rotation speed of the fixing roller 41 is controlled to achieve the relationship, belt peripheral speed Vb<sheet surface movement speed V<upper limit speed Vs. Consequently, tension is applied to the sheet portion Sd of the conveyed sheet S located between the portion nipped and conveyed by the intermediate transfer belt 21 and the secondary transfer roller 26 at the secondary transfer position 261 and the portion nipped and conveyed by the fixing roller 41 and the pressure roller 42 at the fixing position 45. In this manner, transfer shift and sheet wrinkles are prevented. However, the present invention is not limited to those structures.

In an apparatus that uses cut paper sheets, for example, transfer shift, rather than wrinkles, is more likely to occur at the secondary transfer position 261 due to the tensile force generated when tension is applied to the sheet portion Sd of a cut paper sheet, depending on the structure of the fixing unit, or particularly on the heating temperature of the fixing roller 41 and the pressures applied by the fixing roller 41 and the pressure roller 42. In such an apparatus, the sheet portion Sd of each cut paper sheet is loosened (by forming a loop), instead of being subjected to tension.

This loop formation can be performed through the above described loop amount control. However, if the peripheral speed of the fixing roller 41 becomes higher due to thermal expansion of the fixing roller 41, and the relationship in which the belt peripheral speed Vb is lower than the sheet surface movement speed V lasts long, the loop amount becomes smaller, and tension might be applied to the sheet portion Sd of the cut paper sheet, resulting in transfer shift.

In view of this, loop amount control is performed in the following manner. The target speed of the sheet surface movement speed V is set at a speed Vs1 that is lower than the belt peripheral speed Vb (the system speed), and at a speed Vs2 that is higher than the belt peripheral speed Vb. The target speed of the sheet surface movement speed V is alternately switched between Vs1 and Vs2 at regular intervals so that the loop amount falls within an appropriate range. The sheet surface movement speed V of the cut paper sheet being conveyed by the fixing roller 41 is measured by the sensor 44. When the target speed is Vs1, the rotation speed of the fixing roller 41 is controlled so that the measured value becomes equal to the target speed Vs1. When the target speed is Vs2, the rotation speed of the fixing roller 41 is controlled so that the measured value becomes equal to the target speed Vs2.

With this structure, a loop of an appropriate size can be formed at the sheet portion Sd of the cut paper sheet, regardless of whether the fixing roller 41 thermally expands. The same applies in a case where a long continuous paper sheet is used. The above target speeds Vs1 and Vs2, and the regular intervals are determined beforehand through experiments and the like in accordance with the apparatus.

In an apparatus that does not apply any tension to the sheet portion Sd and does not form any loop, or in an apparatus that performs control so that the sheet surface movement speed becomes equal to the belt peripheral speed Vb, the target speed Vt of the sheet surface movement speed can be set beforehand at the value equal to the belt peripheral speed Vb.

(6) In the above described embodiments, each of the image forming apparatuses according to the embodiments of the present invention is applied to a tandem color printer in which an intermediate transfer method is implemented. However, the present invention is not limited to those embodiments. An image forming apparatus according to an embodiment of the present invention may be an apparatus that can form color images by a method other than the intermediate transfer method, or may be an apparatus that can form only monochrome images.

In a printer that can form only monochrome images, an image formed on the single photosensitive drum (the image carrier) is transferred directly onto a sheet S at the transfer position, and therefore, no color shift occurs. However, the difference between the sheet surface movement speed of the sheet S being conveyed by the fixing roller 41 and the peripheral speed of the photosensitive drum might become larger due to thermal expansion of the fixing roller 91. In that case, transfer shift might occur. In view of this, the sheet surface movement speed of the sheet S being conveyed by the fixing roller 41 is measured with the sensor 44 or the like, so that wrinkles on the sheet S and transfer shift can be both prevented even if the fixing roller 41 thermally expands.

Such a color or monochrome image forming apparatus that transfers an image from an image carrier such as a photosensitive member or an intermediate transfer member onto a sheet passing between the image carrier and a transfer member positioned to face the image carrier at the transfer position, and thermally fixes the image on the sheet while nipping and conveying the sheet with a pair of fixing members after the transfer can be applied to a copying machine, a facsimile machine, an MFP (Multiple Function Peripheral), and the like.

The transfer member is not necessarily the secondary transfer roller 26 in contact with the peripheral surface of an image carrier, but may be a non-contact transfer charger. In that case, a pair of conveyance rollers are further provided in a position that is located on the upstream side of the transfer position in the sheet conveying direction and is close to the transfer position. The sheet S is conveyed to the transfer position by the pair of conveyance rollers.

Further, in the above described embodiments, the fixing roller 91 is the driving side, and the pressure roller 92 is the driven side. However, the pressure roller 42 may be the driving side, and the fixing roller 41 may be the driven side, for example. In such a case, the rotation of the pressure motor that drives and rotates the pressure roller 42 is controlled.

In the above described example structures, both the fixing rollers 41 and the pressure rollers 42 that serve as a pair of fixing members for nipping and conveying the sheet S are rotary members. However, the present invention is not limited to those structures. The fixing members should be able to nip and convey the sheet S, and at least one of the fixing members may be a rotary member. For example, one of the fixing members may be a rotary member such as a fixing roller or a fixing belt, and the other one may be a stationary member such as a rubber fixing pad to be pressed against the rotary member at the fixing position 45.

It is also possible to combine the above described embodiments and the above described modifications in any conceivable manner.

The present invention can be applied to a wide variety of image forming apparatuses that transfer an image from an image carrier onto a sheet.

According to an embodiment of the present invention, the surface movement speed of the sheet being conveyed by a pair of fixing members can be measured. Thus, the conveyance speed of the sheet being conveyed can be maintained at the target speed, regardless of whether the fixing members thermally expand. Consequently, transfer shift due to variation in the peripheral speed of the fixing members caused by thermal expansion can be prevented, while wrinkles on the sheet being conveyed can be prevented when the sheet passes between the fixing members.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus that transfers an image from an image carrier onto a continuous sheet passing between the image carrier rotating and a transfer member, the image forming apparatus comprising:

a fixing unit configured to thermally fix the image on the continuous sheet while nipping and conveying the continuous sheet with a pair of fixing members after the transfer, at least one of the fixing members rotating;

a sensor configured to measure surface movement speed of the continuous sheet in a non-contact manner while the continuous sheet is being conveyed by the fixing members; and a control unit configured to:

control rotation speed of the fixing members in accordance with a result of the measurement carried out by the sensor, to lower the speed of conveyance of the continuous sheet from an initial speed to a target speed, wherein the target speed is determined beforehand and the target speed is above a peripheral speed of the image carrier, the control being performed while the continuous sheet being conveyed is in contact with at least the transfer member and the fixing members, maintain the conveyance speed of the continuous sheet at about the target speed, and control the rotation speed of the fixing members to be higher than the peripheral speed of the image carrier, wherein the sensor includes a light source configured to emit a light beam toward one of a front surface and a back surface of the continuous sheet passing through a predetermined measurement position, the predetermined measurement position being located on a downstream side of the transfer member in a continuous sheet conveying direction and on an upstream side of the fixing members in the continuous sheet conveying direction in a continuous sheet conveyance path.

2. The image forming apparatus according to claim 1, wherein the control unit controls the rotation speed of the fixing members such that the conveyance speed of the continuous sheet is maintained at the target speed that is higher than the peripheral speed of the image carrier by a certain value.

3. The image forming apparatus according to claim 2, wherein the transfer member is a transfer roller in contact with a peripheral surface of the image carrier.

4. The image forming apparatus according to claim 1, wherein the sensor further includes a two-dimensional sensor configured to receive light reflected from the one surface, the reflected light being of the light beam emitted onto the one surface of the continuous sheet, and the sensor measures the surface movement speed of the continuous sheet in accordance with a rate of change in the amount of the reflected and received light.

5. The image forming apparatus according to claim 4, wherein the light source is one of a laser light source and an LED light source, and the sensor receives one of a speckle pattern and a shade pattern with the two-dimensional sensor, and measures the surface movement speed of the continuous sheet in accordance with a rate of change in the amount of the reflected and received light caused by a rate of change in the received pattern, the one of the speckle pattern and the shade pattern being formed by minute irregularities on the one surface of the continuous sheet being conveyed when the light beam is emitted from the one of the laser light source and the LED light source onto the one surface.

6. The image forming apparatus according to claim 5, wherein an angle between the light beam emitted onto the one surface of the continuous sheet and the one surface of the continuous sheet is between 20 degrees and 45 degrees, and the two-dimensional sensor is located in a position where light reflected at 90 degrees with respect to the one surface of the continuous sheet can be received.

7. The image forming apparatus according to claim 4, wherein the predetermined measurement position is a position where the light beam reflected by the one surface of the continuous sheet is not blocked by the fixing members, and is the position closest possible to the fixing members in the continuous sheet conveying direction.

8. The image forming apparatus according to claim 4, wherein the image is formed on only one of the front surface and the back surface of the continuous sheet, and the sensor emits the light beam onto the other one of the front surface and the back surface of the continuous sheet being conveyed, any image not being to be formed on the other surface of the continuous sheet.

9. The image forming apparatus according to claim 1, wherein the control unit determines whether there exists a difference from the target speed every time obtaining the surface movement speed of the continuous sheet measured by the sensor, and, when there exists a difference in speed, controls the rotation speed of the fixing members to cancel out the difference.

10. The image forming apparatus according to claim 1, further comprising a second sensor configured to measure peripheral surface movement speed of the image carrier in a non-contact manner, wherein, where Vp represents a target speed of the peripheral surface movement speed of the image carrier, Vq represents the peripheral surface movement speed measured by the second sensor, Vr represents a value obtained by subtracting Vp from Vq, and a target speed Vt of the surface movement speed of the continuous sheet at the time when the peripheral surface movement speed of the image carrier is equal to the target speed Vp is a reference value, the control unit controls rotation speed of the image carrier in accordance with a result of the measurement carried out by the second sensor, to adjust the peripheral surface movement speed of the image carrier to the target speed Vp, and, every time obtaining the peripheral surface movement speed Vq measured by the second sensor, the control unit calculates Vr by subtracting Vp from Vq, and controls the rotation speed of the fixing members by updating the target speed of the surface movement speed of the continuous sheet with a value obtained by adding Vr to the reference value Vt.

11. The image forming apparatus according to claim 1, which implements an intermediate transfer method, wherein, after toner images in different colors are formed on a plurality of photosensitive members, and the toner images on the photosensitive members are transferred and superimposed onto an intermediate transfer member, the toner images in the respective colors transferred and superimposed onto the intermediate transfer member are transferred onto the continuous sheet passing between the intermediate transfer member and a transfer roller positioned to face the intermediate transfer member, the image carrier is the intermediate transfer member, and the transfer member is the transfer roller.

12. The image forming apparatus according to claim 1, wherein the control unit determines whether a predetermined time after start of an image forming operation has passed, and maintains the conveyance speed of the continuous sheet at about the target speed while it is determined that the predetermined time after the start of the image forming operation has not passed.

13. The image forming apparatus according to claim 1, wherein after start of a sheet feeding period, a sheet surface conveyance speed is set between a peripheral speed of the transfer member and an upper limit value of the surface movement speed of the sheet with which a lowest allowable image quality can be maintained in an image after secondary transfer.

14. An image forming apparatus that transfers an image from an image carrier onto a continuous sheet passing between the image carrier rotating and a transfer member, the image forming apparatus comprising:

a fixing unit configured to thermally fix the image on the continuous sheet while nipping and conveying the continuous sheet with a pair of fixing members after the transfer, at least one of the fixing members rotating;

a sensor configured to measure surface movement speed of the continuous sheet in a non-contact manner while the continuous sheet is being conveyed by the fixing members; and a control unit configured to:

control rotation speed of the fixing members in accordance with a result of the measurement carried out by the sensor, to adjust speed of conveyance of the continuous sheet to a target speed, wherein the target speed is determined beforehand for peripheral speed of the image carrier, the control being performed while the continuous sheet being conveyed is in contact with at least the transfer member and the fixing members, and maintain the conveyance speed of the continuous sheet at about the target speed;

wherein the sensor emits a first light beam from an upstream side in a continuous sheet conveying direction onto one of a front surface and a back surface of the continuous sheet being conveyed while emitting a second light beam from a downstream side in the continuous sheet conveying direction, receives the first and second light beams reflected by the one surface of the continuous sheet, and measures the surface movement speed of the continuous sheet in accordance with a difference in wavelength caused by a Doppler effect between the reflected and received light beams, wherein the first light beam is emitted on the continuous sheet passing through a predetermined measurement position, the predetermined measurement position being located on a downstream side of the transfer member in a continuous sheet conveying direction and on an upstream side of the fixing members in the continuous sheet conveying direction in a continuous sheet conveyance path, and wherein after start of a sheet feeding period, a sheet surface conveyance speed is set between a peripheral speed of the transfer member and an upper limit value of the surface movement speed of the sheet with which a lowest allowable image quality can be maintained in an image after secondary transfer.

15. The image forming apparatus according to claim 14, wherein the control unit determines whether a predetermined time after start of an image forming operation has passed, and maintains the conveyance speed of the continuous sheet at about the target speed while it is determined that the predetermined time after the start of the image forming operation has not passed.

16. An image forming apparatus that transfers an image from an image carrier onto a continuous sheet passing between the image carrier rotating and a transfer member, the image forming apparatus comprising:

a fixing unit configured to thermally fix the image on the continuous sheet while nipping and conveying the continuous sheet with a pair of fixing members after the transfer, at least one of the fixing members rotating;

a sensor configured to measure surface movement speed of the continuous sheet in a non-contact manner while the continuous sheet is being conveyed by the fixing members; and a control unit configured to:

control rotation speed of the fixing members in accordance with a result of the measurement carried out by the sensor, to adjust speed of conveyance of the continuous sheet to a target speed, wherein the target speed is determined beforehand for peripheral speed of the image carrier, the control being performed while the continuous sheet being conveyed is in contact with at least the transfer member and the fixing members, and maintain the conveyance speed of the continuous sheet at about the target speed;

wherein, when an image forming operation is started, the control unit acquires the surface movement speed of the continuous sheet measured by the sensor, and, during a predetermined time after the start of the image forming operation, maintains the rotation speed of the fixing members at the speed measured at the start of the image forming operation, when the predetermined time has passed, the control unit determines whether there exists a difference between the surface movement speed of the continuous sheet measured by the sensor at the time when the predetermined time has passed and the surface movement speed of the continuous sheet measured at the start of the image forming operation, and, when there exists a difference in speed, updates the rotation speed of the fixing members to cancel out the difference, the sensor includes a light source configured to emit a light beam toward one of a front surface and a back surface of the continuous sheet passing through a predetermined measurement position, the predetermined measurement position being located on a downstream side of the transfer member in a continuous sheet conveying direction and on an upstream side of the fixing members in the continuous sheet conveying direction in a continuous sheet conveyance path, and after start of a sheet feeding period, a sheet surface conveyance speed is set between a peripheral speed of the transfer member and an upper limit value of the surface movement speed of the sheet with which a lowest allowable image quality can be maintained in an image after secondary transfer.

17. The image forming apparatus according to claim 16, wherein the control unit controls the rotation speed of the fixing members such that the conveyance speed of the continuous sheet is maintained at the target speed that is higher than the peripheral speed of the image carrier by a certain value.

18. The image forming apparatus according to claim 16, wherein the control unit determines whether a predetermined time after start of an image forming operation has passed, and maintains the conveyance speed of the continuous sheet at about the target speed while it is determined that the predetermined time after the start of the image forming operation has not passed.

* * * * *